US005374910A

United States Patent [19]

Yamagata

[11] Patent Number: 5,374,910

[45] Date of Patent: Dec. 20, 1994

[54] DIELECTRIC FILTER HAVING COUPLING MEANS DISPOSED ON A LAMINATED SUBSTRATE

[75] Inventor: Yoshifumi Yamagata, Kagoshima, Japan

[73] Assignee: Kyocera Corporation, Kyota, Japan

[21] Appl. No.: 982,788

[22] Filed: Nov. 30, 1992

[30] Foreign Application Priority Data

| | | | |
|---|---|---|---|
| Nov. 29, 1991 | [JP] | Japan | 3-098837[U] |
| Nov. 29, 1991 | [JP] | Japan | 3-098838[U] |
| Nov. 29, 1991 | [JP] | Japan | 3-098839[U] |
| Nov. 29, 1991 | [JP] | Japan | 3-316532 |

[51] Int. Cl.[5] ..... H01P 1/202; H01P 1/205

[52] U.S. Cl. ..... 333/206; 333/246

[58] Field of Search ..... 333/202–207, 333/219, 222, 223, 246

[56] References Cited

U.S. PATENT DOCUMENTS

| | | | |
|---|---|---|---|
| 4,906,955 | 3/1990 | Yorita et al. | 333/202 X |
| 5,036,301 | 7/1991 | Takao et al. | 333/246 X |
| 5,157,365 | 10/1992 | Hoang | 333/206 |
| 5,196,813 | 3/1993 | Nakakubo | 333/206 |

FOREIGN PATENT DOCUMENTS

| | | | |
|---|---|---|---|
| 61-15401 | 1/1986 | Japan . | |
| 61-192101 | 8/1986 | Japan . | |
| 0311801 | 12/1988 | Japan | 333/202 |
| 1-153703 | 10/1989 | Japan . | |
| 0179002 | 7/1990 | Japan | 333/202 |
| 0249401 | 9/1992 | Japan | 333/202 |

*Primary Examiner*—Seungsook Ham
*Attorney, Agent, or Firm*—Spensley Horn Jubas & Lubitz

[57] ABSTRACT

A dielectric filter comprises a filtering member made up of resonators, intercoupled through a laminated substrate joined to the filtering member and containing interlaminal patterned conductive platings constituting capacitive and inductive elements. Electric field leakage arising among the conductive platings is reduced, improving the effective dielectric constant of the substrate. The extent of the conductive platings providing desired capacitance and selected electrical length is reducible, to decrease the size of the substrate. Furthermore, the substrate construction prevents foreign matter from becoming lodged on, or even from being brought into contact with, the conductive platings, stabilizing capacitive coupling.

10 Claims, 16 Drawing Sheets

DIELECTRIC FILTER HAVING COUPLING MEANS DISPOSED ON A LAMINATED SUBSTRATE

BACKGROUND OF THE INVENTION

The present invention relates to a dielectric filter. More specifically, it relates to a dielectric filter used as a filter in the microwave band.

Personal radio telephones, mobilephones and similar devices operating on microwaves use dielectric filters such as those disclosed, for example, in Japanese Laid-Open Patent Application Nos. 15401/1986 and 192101/1986, and Japanese Laid-Open Utility Model Application No. 153703/1989.

FIG. 20 shows one example of a conventional dielectric filter.

The dielectric filter comprises a filtering member 100 composed of three dielectric resonators 100*a*, 100*b* and 100*c* joined to one another, a substrate 101 having capacitive elements formed thereon, and a case 102 covering the filtering member 100 and the substrate 101.

Each of the dielectric resonators 100*a* to 100*c* has a through-hole 103 extending from its exposed end alongside the substrate 101 to its short-circuited opposite end. An inner conductor 104 is formed on the inner surface of the through-hole 103, and an outer conductor 105 is formed on the outer peripheral surface, excluding the exposed end surface, of the filtering member 100.

Capacitive elements connected to the respective inner conductors of the resonators 100*a* to 100*c* are formed on the substrate 101. The capacitive elements are formed by conductive platings 106, 107 and 108, formed on the upper surface of the substrate 101, and conductive platings 109 and 110 (see broken lines in FIG. 21) formed on the reverse surface thereof. In particular, the conductive platings 106, 107 and 108 are patterned so as to include inter-extensive sections. Capacitance K is effected between the inter-extensive sections thus coupling the resonators. In addition, input-/output capacitive couplings $C_{IN}$ and $C_{OUT}$ to the resonators are formed between the conductive platings 106 and 108 on the upper surface of the substrate, and the respectively corresponding conductive platings 109 and 110 opposite on the reverse surface.

The conductive platings 106 to 108 on the surface of the substrate 101 are respectively connected to the inner conductors 104 of the corresponding resonators 100*a* to 100*c* by, for example, conductive wires 11.

The conductive platings thus forming the capacitive elements of such a conventional dielectric filter are superficially exposed. Consequently, electric field leakage arises between the adjacent conductive plating pairs 106/107, and 107/108, such that the effective dielectric constant decreases. In order to obtain a predetermined coupling capacitance K, therefore, the size of the conductive platings on the surface of the substrate must be large enough to compensate, limiting the extent to which the size of the substrate, and therefore of the entire dielectric filter, can be reduced.

Furthermore, if conductive foreign matter, for example, excess solder in attaching a case 102, or pieces of the outer conductor 105 which may break off in tuning the resonators, lodges between the conductive platings on the surface of the substrate, desired coupling capacitance will not obtain.

In a different approach, the aforementioned Japanese Laid-Open Patent Application No. 192101/1986 discloses a dielectric filter of construction wherein conductor and ground electrode platings are formed on the surface of a substrate, and resonator inner conductors are connected to respective conductor platings. In this construction, capacitive coupling between the resonators is effected between adjacent conductor platings, and a frequency-adjusting capacitance is effected between the conductor and the ground electrode platings. The formation of frequency-adjusting capacitance allows the resonators to be of decreased length.

Also in this construction, however, capacitive elements are formed in the superficial patterning on the substrate. Consequently, electric field leakage similarly arises between the platings, such that the effective dielectric constant decreases.

Furthermore, in the foregoing conventional construction, since the conductive platings are formed superficially on the substrate, the capacitive elements among the conductive platings are liable to be affected by stray capacitances, hindering the attainment of desired filter characteristics. To address this problem, Japanese Laid-Open Utility Model Application No. 153703/1989 discloses a dielectric filter of construction wherein a ground electrode plating includes extensions which separate from one another conductor platings connected to respective resonator inner conductors. However, with this construction it also is not possible to overcome, satisfactorily, the adverse effects of stray capacitances.

A dielectric filter constructed such that a microstrip line is formed between conductive platings on the surface of a substrate is further known conventionally. A plurality of resonators are electrically connected to one another by this microstrip line.

However, since the plating constituting the microstrip line is exposed on the substrate, electric field leakage arises, particularly around patterned features of the microstrip, decreasing the effective dielectric constant. The electrical equivalent length of the microstrip must be increased, therefore, the actual length of the patterned microstrip is increased. Consequently, this limits the extent to which miniaturization of the microstrip patterned plating, and thus of the substrate, is possible.

Moreover, if conductive foreign matter sticks to, or is otherwise brought into contact with the microstrip line, coupling capacitances will fluctuate widely. Wherein no ground electrode plating is formed on the reverse surface of the substrate, the microstrip line develops inductance through its patterned arrangement. Also in this case, however, the coupling capacitances fluctuate widely wherein conductive foreign matter lodges on the microstrip line.

SUMMARY OF THE INVENTION

An object of the present invention is to enable further miniaturization of a dielectric filter.

Another object of the present invention is to stabilize filtering characteristics therein.

Still another object of the present invention is to reduce breakdown due to stray capacitances.

According to one aspect of the present invention, a dielectric filter comprises a filtering member having a plurality of resonators, a laminated substrate, and patterned conductive platings forming capacitive or inductive coupling elements. The substrate is constructed by laminating a plurality of substrate layers and is joined to the filtering member. The platings constituting the coupling elements are formed interiorly of the substrate and couple the plurality of resonators to one another.

The conductive platings are thus formed interlaminally within the substrate, thereby realizing a reduction in electric field leakage arising among the coupling elements, and improving the effective dielectric constant therein. This allows the size of the conductive platings, dimensioned for obtaining predetermined capacitance or predetermined electrical length, to be reduced, making it possible to reduce the size of the substrate and therefore of the entire dielectric filter. In addition, the structure prevents conductive foreign matter from becoming lodged on the conductive platings, ensuring stability in the capacitive couplings.

A dielectric filter according to the present invention in another aspect comprises a filtering member, a laminated substrate, and a case. The filtering member comprises a plurality of resonators composing a dielectric block, perforated by a plurality of through-holes along the bores of which inner conductors are formed, and an outer conductor formed on a portion of the exterior surface of the dielectric block. On the upper surface of the substrate joined to the filtering member are a plurality of island electrode platings connected to respective inner conductors thereof, and a ground electrode plating having extended sections segregating the island electrode platings from one another. The case incorporates conductive partitions connected to the extended sections of the ground electrode plating.

Herein, each of the island electrode platings on the obverse surface of the substrate is surrounded by the ground electrode plating, the conductive partitions at potential ground, and the case. Consequently, stray capacitances do not superimpose on the island electrodes, stabilizing the filtering characteristics.

These and other objects and advantages of the present invention will be more fully apparent from the following detailed description.

DESCRIPTION OF THE PREFERRED EMBODIMENTS

Embodiment 1

Figure 1A:
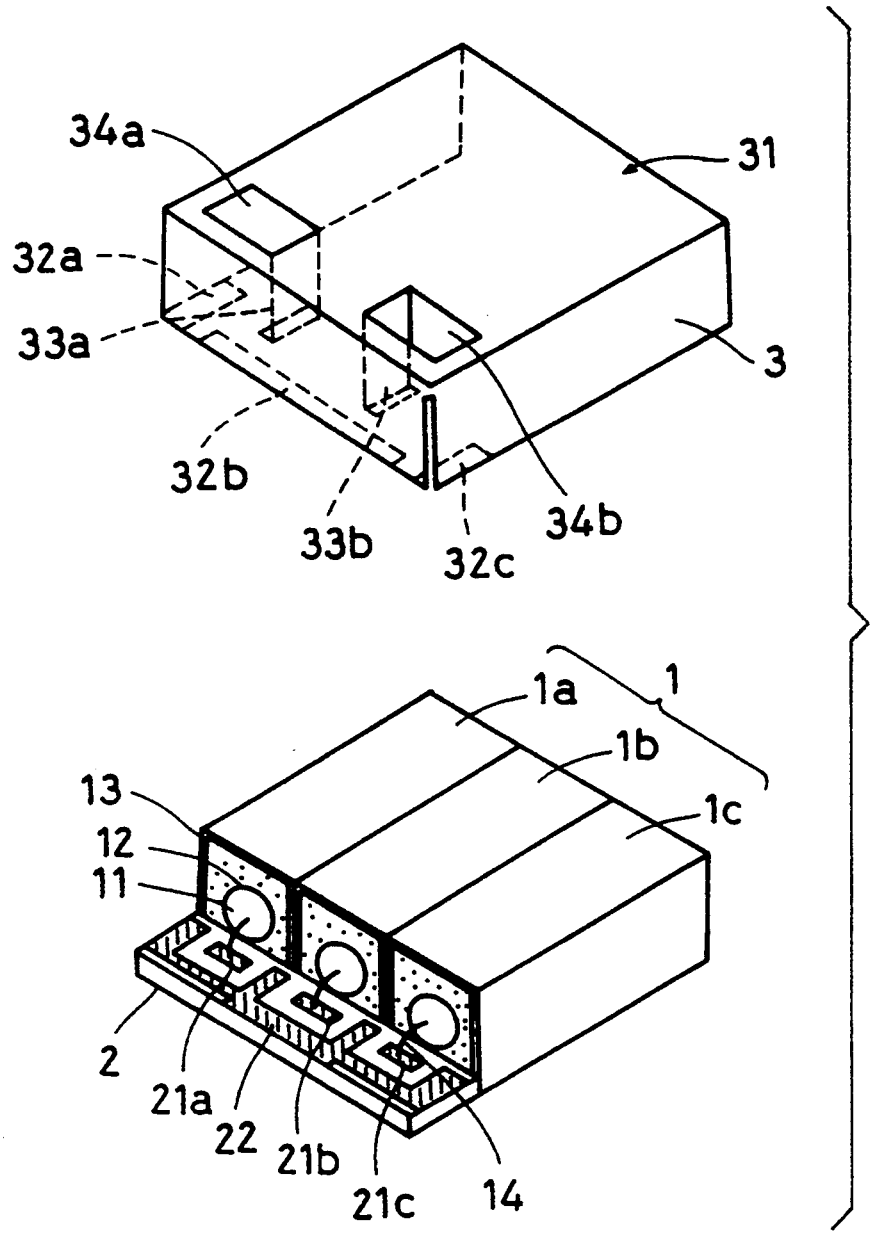
FIG. 1A is an exploded perspective view showing a dielectric filter according to a first embodiment of the present invention.
Figure 1B:
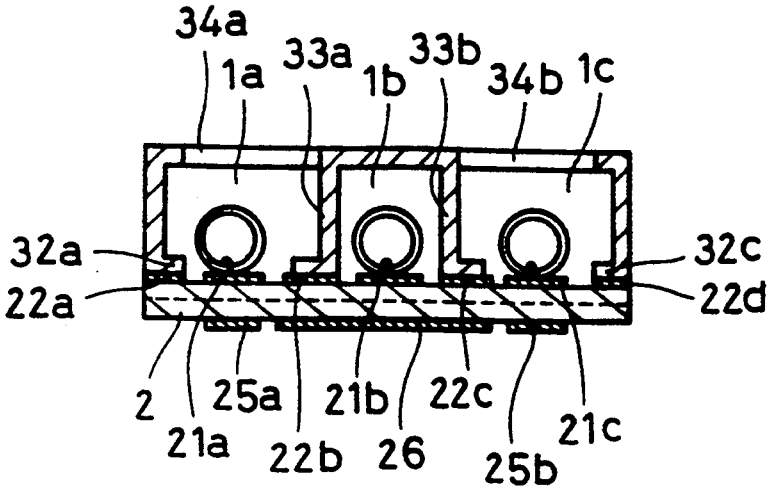
FIG. 1B is a cross sectional view of the dielectric filter shown in FIG. 1A.
Figure 2:
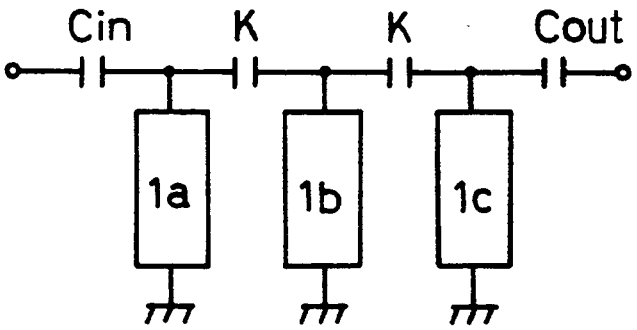
FIG. 2 is a schematic diagraming an equivalent circuit of the dielectric filter shown in FIG. 1A.

FIGS. 1A, 1B and 2 show a dielectric filter according to a first embodiment of the present invention.

The dielectric filter comprises a filtering member 1 composed of three dielectric resonators 1*a*, 1*b* and 1*c*; a laminated substrate 2 having coupling capacitive elements K and input/output capacitive elements $C_{IN}$ and $C_{OUT}$; and a case 3 covering the filtering member 1 and the laminated substrate 2.

Each of the dielectric resonators 1*a*, 1*b* and 1*c* is formed by coating a dielectric block with a conductive film. The blocks are made of ceramic compounds of $BaO-TiO_2$; $ZrO_2-SnO_2-TiO_2$; $BaO-Sm_2O_3-TiO_2$; $BaO-Nd_2-Nd_2O_3-TiO_2$; or $CaO-TiO_2-SiO_2$, having a predetermined dielectric constant. The length of the blocks is predetermined to correspond to the resonant frequency. Each of the blocks is press-formed into a predetermined shape having a through-hole 11, and then is fired. The through-hole 11 formed in each of the blocks extends from an exposed end, adjacent the joined edge of the laminated substrate 2, to its opposite, short-circuited end.

An inner conductor 12 is formed on the bore surface of the through-hole 11, and an outer conductor 13 is formed on that portion of the peripheral surface of the block excluding the exposed end. The inner conductor 12 and the outer conductor 13 are formed by coating the respective surfaces of the block with silver, copper or the like, using such a process as printing, coating, transfer or plating, followed by firing. The outer conductor 13 also covers the short-circuited end, effecting conduction between it and the inner conductor 12.

In each of the dielectric resonators thus constructed, a capacitive element formed through the dielectric as contained between the inner conductor 12 and the outer conductor 13, and an inductive element determined by the length of the current path between the inner conductor 12 and the outer conductor 13, constitute an equivalent L-C resonance circuit.

The three dielectric resonators 1*a*, 1*b* and 1*c* are integrally joined to one an other through solder or conductive adhesive.

Figure 3A:
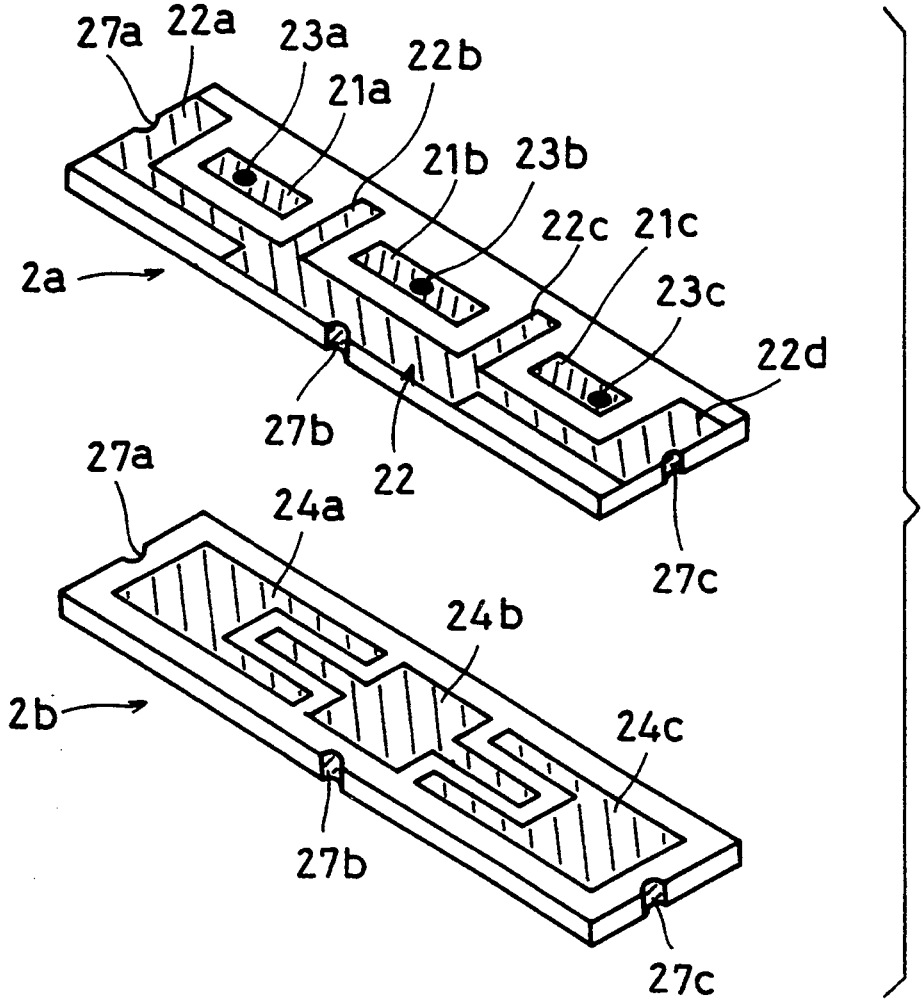
FIG. 3A is an exploded perspective view showing a substrate used in the dielectric filter of FIG. 1A.

The laminated substrate 2 is made of a dielectric ceramic material such as alumina, and has a twofold structure comprising an upper substrate layer 2*a* and a lower substrate layer 2*b*, as shown in exploded view in FIG. 3A. Three island electrode platings 21*a*, 21*b* and 21*c*, and a ground electrode plating 22 are formed on the upper surface of the upper substrate layer 2*a*. Through-holes, or ports 23*a*, 23*b* and 23*c* having conductors on at least their bore surfaces are respectively formed in the three island electrode platings 21*a*, 21*b* and 21*c*. The ground electrode plating 22 is formed as a comb pattern having extended sections 22*a*, 22*b*, 22*c* and 22*d* segregating the island electrode platings 21*a*, 21*b* and 21*c* from one another. The extended sections prevent stray capacitance arising between electrodes 21*a* and 21*c* among the three island electrode platings 21*a*, 21*b* and 21*c*.

Three conductive platings 24*a*, 24*b* and 24*c* constituting capacitive elements are formed on the upper surface of the lower substrate layer 2*b* (the surface adjoining on the upper substrate layer 2*a*). The conductive platings 24*a* to 24*c* are electrically connected to the island electrodes 21*a*, 21*b* and 21*c* through the ports 23*a*, 23*b* and 23*c*, respectively. In addition, sections along the middle on either side of the conductive plating 24*b* extend into respective conductive platings 24*a* and 24*c*, and each of the conductive platings 24*a* and 24*c* has extended sections formed so as to flank a corresponding extension of the conductive plating 24*b*. In this construction, the two capacitive couplings K are formed among the complementarily patterned conductors.

Figure 3B:
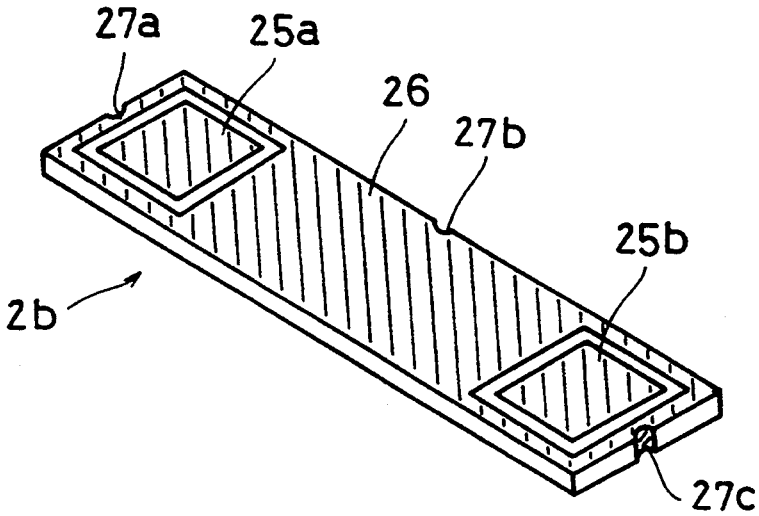
FIG. 3B is a view of the reverse surface of the substrate shown in FIG. 3A.

Input/output conductive platings 25*a* and 25*b* and a ground electrode plating 26 are formed on the reverse surface of the lower substrate layer 2*b* so as to correspond to the conductive platings 24*a* and 24*c*, as shown in FIG. 3B. The ground electrode plating 26 is formed on almost the entirety of the reverse surface of the substrate 2*b*, wherein it surrounds the island-shaped input/output conductive platings 25*a* and 25*b*.

End channels 27*a*, 27*b* and 27*c* are formed on the end surfaces of both the substrates 2*a* and 2*b* such that conduction occurs between the upper and lower ground electrode platings 22 and 26.

At least one side of the case 3 is open, such that it caps the filtering member 1 and the laminated substrate 2. In the present embodiment, the case 3 includes an open side 31 at the short-circuited end, in addition to the bottom surface being open. In addition, inwardly-bent tabs 32*a*, 32*b* and 32*c* are formed in respective portions of the lower ends of the three side walls of the case 3, as shown in FIGS. 1A and 1B. The tabs 32*a*, 32*b* and 32*c* are connected to the ground electrode plating 22 on the surface of the substrate. Furthermore, inwardly-bent partitions 33*a* and 33*b* are formed from the upper wall of the case 3, forming windows 34*a* and 34*b* therein. The partitions 33*a* and 33*b* are connected to the extended sections 22*b* and 22*c* on the upper surface of the substrate, and segregate the island electrodes 21*a*/21*b*, and 21*b*/21*c*, from each other respectively. Partitioning members provided separately may be disposed in place of the bent partitions 33*a* and 33*b*.

The case 3 is electrically joined to the outer conductor 13 on the exterior surface of the filtering member 1 by conductive adhesive such as solder. In joining the case 3 to the filtering member 1 and the laminated substrate 2, the junctions therein provide firmness, and almost the entirety of the exterior conductor 13 of the filtering member 1 is grounded to potential ground. A plurality of ground terminals bent outward may be formed in edges of the open side 31 of the case 3, as required.

It is desirable that end portions of the bent partitions, or conductive partitioning plates, (hereinafter referred to as partitions), 33*a* and 33*b* are so bent as to be flush with the laminated substrate 2, so that the case 3 can be easily connected to the laminated substrate 2.

Wherein the partitions 33*a* and 33*b* are connected to the ground electrode extended sections 22*b* and 22*c*, respectively, on the laminated substrate 2, the partitions 33*a* and 33*b* thus are previously set into predetermined positions in the case 3. In addition, solder cream or the like is applied on the ground electrode extended sections 22*b* and 22*c*. When the filtering member 1 and the laminated substrate 2 are covered with the case 3, the partitions 33*a* and 33*b* abut on the ground electrode extended sections 22*b* and 22*c*. When the case 3 is soldered to the filtering member 1 and the laminated substrate 2, the solder cream on the ground electrode extended sections 22*b* and 22*c* is melted.

Furthermore, the case 3 may be joined to the filtering member 1 and the laminated substrate 2 by supplying molten solder through the windows 34*a* and 34*b* of the case 3 after the partitions 33*a* and 33*b* are brought into abutment on the ground electrode extended sections 22*b* and 22*c* on the laminated substrate 2, without using solder cream therein.

The partitions 33*a* and 33*b* are thus connected to the ground-electrode extended sections 22*b* and 22*c* segregating the island electrodes 21*a*, 21*b* and 21*c*, and are essentially perpendicular to the laminated substrate 2. Accordingly, the island electrodes 21*a*, 21*b* and 21*c* are segregated both two-dimensionally, by the ground electrode extended sections 22*b* and 22*c*, and in addition, three-dimensionally, by the conductive partitions 33*a* and 33*b*, and the case 3. Consequently, stray capacitances or the like arising among the island electrodes 21*a*, 21*b* and 21*c*, and the exterior, which would otherwise adversely affect the coupling of capacitive elements K among the resonators 1*a*, 1*b* and 1*c*, are restrained, thereby realizing desired stability in filtering characteristics.

In the dielectric filter thus constructed, inter-plating capacitance between the patterned conductive platings 24*a* and 24*b* is the coupling capacitive element K coupling the resonators 1*a* and 1*b*, and that between the patterned conductive platings 24*b* and 24*c* is the coupling capacitive element K coupling the resonators 1b and 1c. In addition, capacitance arising between the conductive plating 24a and the electrode 25a, wherein the lower layer substrate 2b is sandwiched therebetween, is the input capacitance $C_{IN}$ coupling the resonator 1a; and capacitance arising between the conductive plating 24c and the electrode 25b, wherein the lower layer substrate 2b is sandwiched therebetween, is the output capacitance $C_{OUT}$ coupling the resonator 1c.

Figure 4:
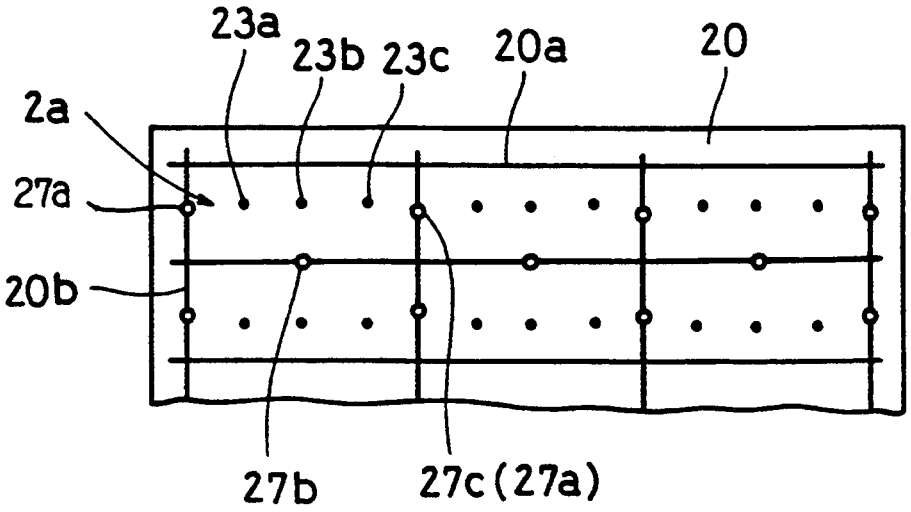
FIG. 4 is a diagram for explaining a method of fabricating the substrate shown in FIG. 3A.

A method of fabricating the laminated substrate 2 will be outlined, with reference to FIG. 4.

Two alumina green stock sheets are first prepared.

A stock sheet 20 serving as an upper substrate layer 2a is provided with braking grooves 20a and 20b at right angles, dividing it into regions each of which will serve to form a laminated substrate 2, as shown in FIG. 4. At the same time, holes serving as ports 23a, 23b and 23c, and end-surface channels 27a, 27b and 27c are formed by punching-perforating. The holes serving as the ports 23a, 23b and 23c are formed in those places where island electrodes 21a, 21b and 21c are to be formed; and the holes serving as the channels 27a, 27b and 27c are formed so as to intersect the braking grooves 20a and 20b at respective positions. Specifically, the hole serving as the end surface channel 27c in the upper left substrate section in FIG. 4 is one with the hole serving as the channel 27a in the center substrate section in FIG. 4, and the hole serving as the channel 27b in the upper left substrate section in FIG. 4 is one with the hole serving as the channel 27b in the second-layer substrate section on the left.

Plating is done while applying suction through the ports 23a, 23b and 23c and the end surface channel holes 27a, 27b and 27c using a conductive paste containing Ag or an Ag alloy, Cu or a Cu alloy, or the like, thereby forming a conductive film on at least the bore surface of each of the port and channel holes.

On a alumina green stock sheet serving as a lower layer substrate 2b, the three conductive patterned platings 24a, 24b and 24c are then formed on that surface of the lower layer substrate 2b which is brought into contact with the upper layer substrate 2a, for each region which forms a laminated substrate 2, by a screen printing process using the above-described conductive paste, and then are dried.

The two stock sheets thus formed are aligned, integrated by hot-pressing, and then fired in normal atmosphere at a temperature of approximately 900° C., thereby to sinter the stock sheets integrally, with the conductive platings 24a, 24b and 24c contained interiorly. Consequently, a bulk laminated substrate interiorly containing the patterned conductive platings 24a, 24b and 24c constituting coupling capacitive elements K is fabricated.

Three island electrode platings 21a, 21b and 21c and a ground electrode plating 22 are formed by the screen printing process using conductive paste including Ag or an Ag alloy, Cu or a Cu alloy, or the like, on each region which will serve as a separate laminated substrate 2 on the upper surface of the bulk substrate, laminated by sintering. The platings then are then dried.

Furthermore, input/output conductive platings 25a and 25b and a ground electrode plating 26 are likewise formed on each region which will serve as a separate laminated substrate 2 on the reverse surface of the bulk laminated substrate.

The bulk laminated substrate having the electrode patterns 21a, 21b, 21c, 22; and 25a, 25b and 26 formed on the respective surfaces is then fired again, to bake on the platings.

Finally, the bulk laminated substrate is sectioned along the braking grooves 20a and 20b, thereby to obtain a plurality of substrates 2 of predetermined size.

In the fabricating method, it is preferable that the interlaminal conductive platings 24a, 24b and 24c are printed on the surface of the alumina green stock sheet reverse to the upper-layer side in which the ports 23a, 23b and 23c are formed, since this way the conductive film in the ports 23a, 23b and 23c and the interlaminal conductive platings 24a, 24b and 24c can be formed by one printing process, ensuring reliability of the connections thereamong.

The laminated substrate 2 and the filtering member 1 formed as described above are fixed to each other by solder in enclosing the filtering member 1 and the laminated substrate 2 with the case 3. In addition, the island electrodes 21a, 21b and 21c formed on the upper surface of the laminated substrate 2 are electrically connected to inner conductors 12 of three resonators 1a, 1b and 1c by wires 14.

Particularly in this embodiment, the three conductive platings 24a, 24b and 24c constituting the coupling capacitive elements K, coupling the resonators 1a, 1b and 1c mounted on the laminated substrate 2 to one another, are formed between the upper substrate layer 2a and the lower substrate layer 2b, whereby electric field leakage arising between the platings 24a and 24b, and between the platings 24b and 24c is restrained, substantially improving the effective dielectric constant of the substrate. Therefore, it is possible to obtain predetermined capacitance through narrowed spacings between the platings 24a and 24b, and between the platings 24b and 24c, and through decreased plating lengths. Consequently, it is possible to reduce the size of the laminated substrate 2 and therefore of the whole dielectric filter.

Furthermore, the conductive platings 24a, 24b and 24c are formed interiorly of the laminated substrate 2, whereby conductive foreign matter cannot become lodged among them. Therefore, stable capacitive coupling elements are obtained, realizing a dielectric filter exhibiting stable characteristics. [Modified Example]

Figure 5:
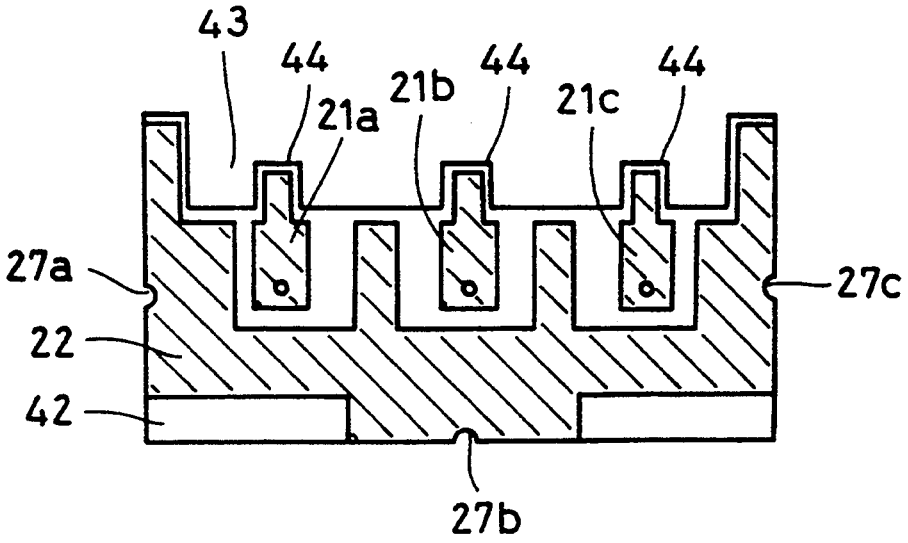
FIG. 5 is a plan view of a substrate in a modified example of the first embodiment.

FIG. 5 shows a modified example of the first embodiment.

This example is for joining a substrate 42 and a filtering member 1 to each other more firmly. A notch 43 into which the filtering member 1 fits is formed in the edge of the substrate 42 alongside of the filtering member 1. The filtering member 1 composed of three integrally-formed resonators is securable into the notch 43, whereby the substrate 42 and the filtering member 1 are mechanically joined to each other more firmly.

Figure 6:
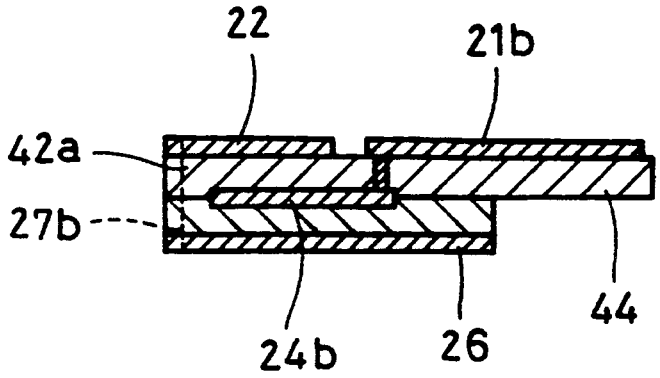
FIG. 6 is a cross sectional view of the substrate shown in FIG. 5.

Coupling projections 44, which insert into the through-holes 11 of resonators 1a, 1b and 1c, are formed in the notch 43. These coupling projections 44 are formed as extensions from an upper substrate layer 42a of the laminated substrate 42, as shown in FIG. 6. Along the surfaces of the coupling projection 44, island electrode platings 21a, 21b and 21c are formed extending thereon. Consequently, respective sections of the island electrodes 21a, 21b and 21c extend into the inner conductors of the resonator 1a, 1b and 1c through-holes 11, whereby connection as in the above-described first embodiment can be accomplished simply by supplying molten solder. In this case, the reliability of the electrical connection between the island electrodes 21a, 21b and 21c on the substrate, and the inner conductors 12 is improved.

Figure 7:
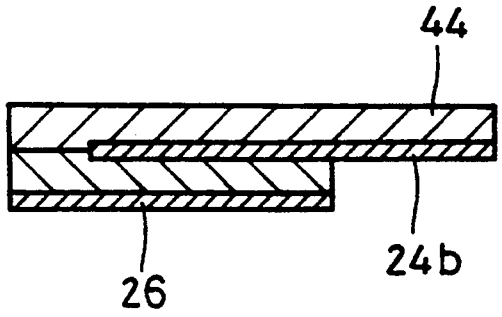
FIG. 7 is a cross sectional view of a substrate in another modified example of the first embodiment.

Moreover, as shown in FIG. 7, conductive film connected to the inner conductors 12 of the resonators 1a, 1b and 1c may be formed on the reverse surfaces of the coupling projections portions 44. In this case, at the same time that conductive platings 24a, 24b and 24c are formed on the surface of the substrate 42a opposite the upper-layer side, ends of the platings therein are extended.

In the example thus as shown in FIG. 7, the island electrodes 21a, 21b and 21c, the ports 23a, 23b and 23c, and the ground electrode plating 22 on the upper, upper surface of the laminated substrate are not required, thereby enabling simplification of the structure.

Embodiment 2

Figure 8:
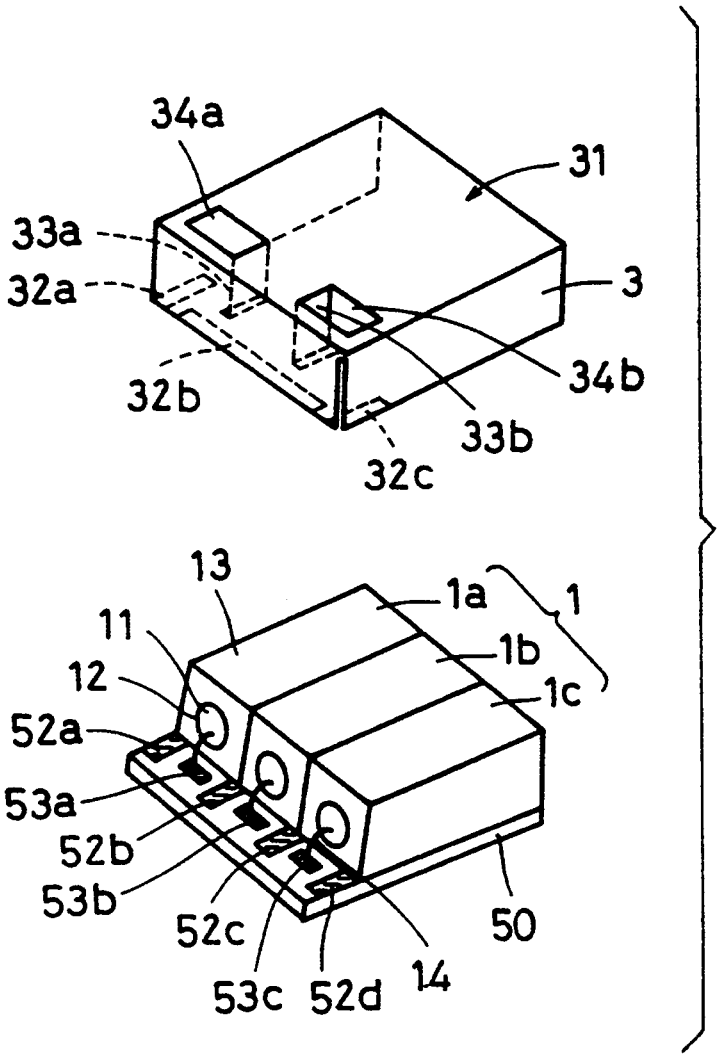
FIG. 8 is a exploded perspective view showing a dielectric filter according to a second embodiment of the present invention.
Figure 9:
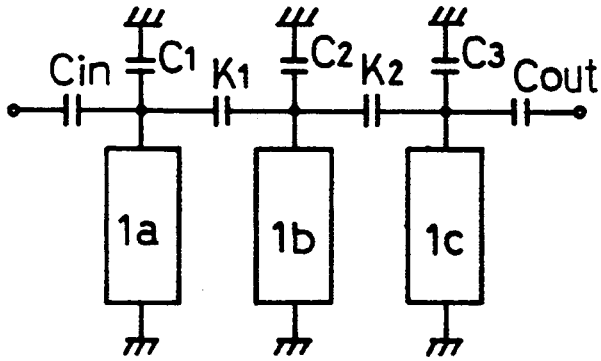
FIG. 9 is a schematic diagraming an equivalent circuit of the dielectric filter shown in FIG. 8.

FIGS. 8 and 9 show a dielectric filter according to a second embodiment of the present invention.

The dielectric filter according to this embodiment comprises a filtering member 1 having three adjoining dielectric resonators 1a, 1b and 1c; a substrate 50 providing coupling capacitive elements K1 and K2, input-/output capacitive elements $C_{IN}$ and $C_{OUT}$ and parallel capacitive elements $C_1$, $C_2$ and $C_3$; and a case 3 covering the filtering member 1 and the substrate 50.

The dielectric resonators 1a, 1b and 1c have the same structure as that of the dielectric resonators illustrated in the above-described first embodiment. The case 3 is also of the same structure as that in the first embodiment. In the present embodiment, the filtering member 1 is mounted on the upper surface of the substrate 50 and is fixed thereto by conductive adhesive such as solder.

Figure 10A:
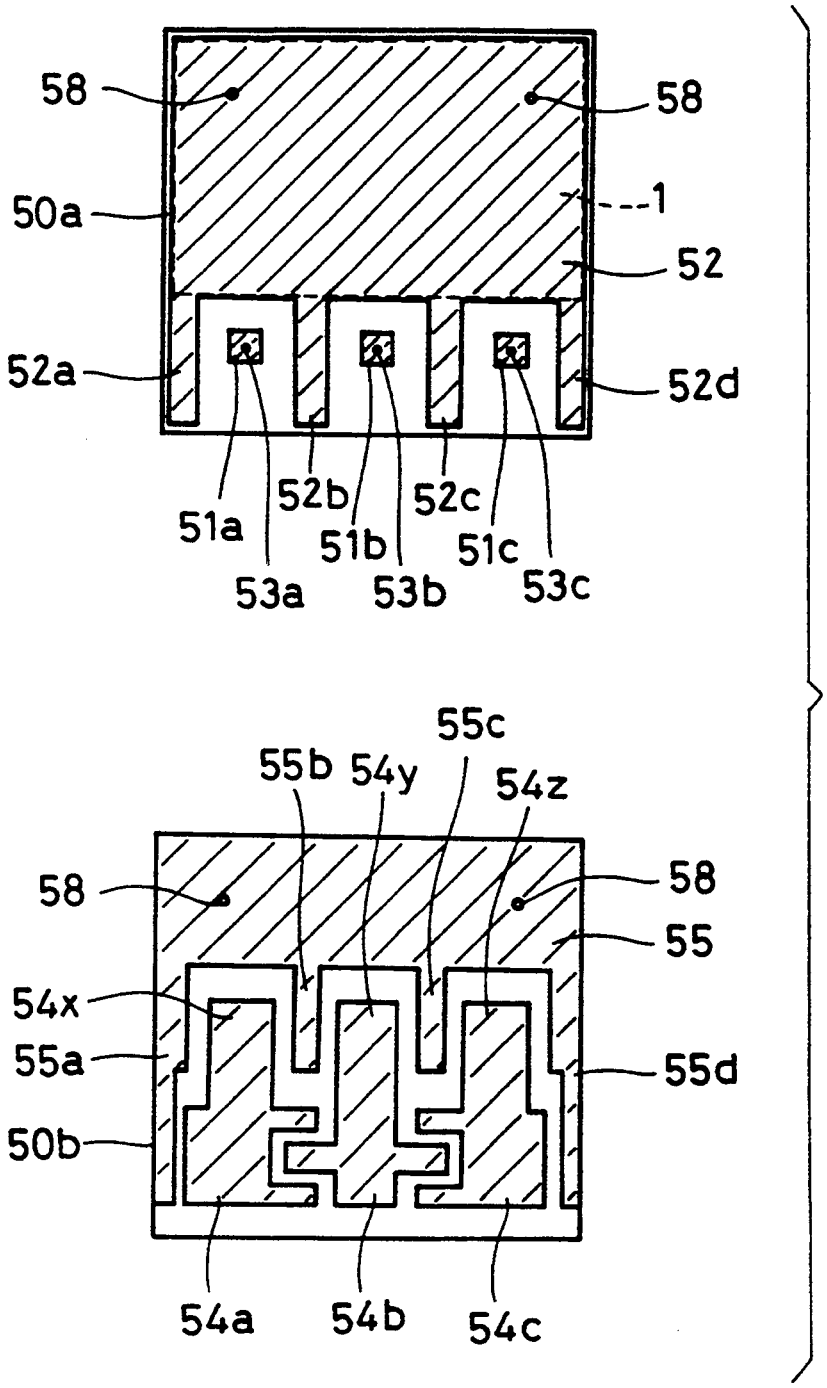
FIG. 10A is a split-level exploded plan view showing a substrate used in the dielectric filter shown in FIG. 8.
Figure 10B:
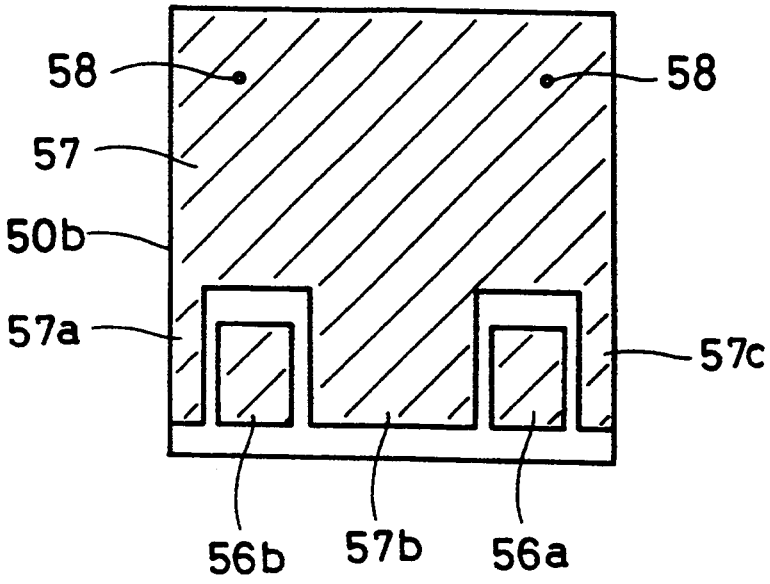
FIG. 10B is a view of the reverse surface of the substrate shown in FIG. 10A.

The substrate 50 has a twofold structure comprising an upper substrate layer 50a and a lower substrate layer 50b, as shown in FIGS. 10A and 10B. Three island electrode platings 51a, 51b and 51c, and a ground electrode plating 52, are formed on the upper surface of the upper layer substrate 50a, as shown in FIG. 10A. In addition, ports 53a, 53b and 53c are formed in the three island electrodes 51a, 51b and 51c, respectively. The ground electrode plating 52 has extended sections 52a, 52b, 52c and 52d for segregating the island electrodes 51a, 51b and 51c from one another, thereby to prevent stray capacitances arising between the island electrodes 51a and 51c among the three island electrodes 51a, 51b and 51c.

Three conductive platings 54a, 54b and 54c constituting capacitive elements having portions 54x, 54y and 54z extended therefrom, are formed on the upper surface of the lower substrate layer 50b. Conduction occurs respectively between the conductive platings 54a, 54b and 54c and the island electrodes 51a, 51b and 51c, through the ports 53a, 53b and 53c. In addition, a ground electrode plating 55, having extended sections 55a, 55b, 55c and 55d, is formed so as to surround the conductive platings 54a, 54b and 54c.

Input/output conductive platings 56a and 56b, and a ground electrode plating 57, are formed so as to correspond to the conductive platings 54a and 54c on the reverse surface of the lower substrate layer 50b, as shown in FIG. 10B. The ground electrode plating 57 includes sections 57a, 57b and 57c extended so as to surround the island-shaped input/output conductive platings 56a and 56b, and is formed to cover almost the entire surface of the lower substrate layer 50b.

The ground electrode plating 52 formed on the upper surface of the foregoing substrate 50a, the ground electrode plating 55 formed interlaminally between the substrate 50a and the substrate 50b, and the ground electrode plating 57 formed on the reverse surface of the substrate 50b are interconnected through one or a plurality of through-holes 58.

In the dielectric filter thus constructed, capacitance effected between the patterned conductive platings 54a and 54b formed interlaminally in the substrate 50 acts as a capacitive coupling element $K_1$ coupling the resonators 1a and 1b. Likewise, capacitance effected between the conductive platings 54b and 54c acts as a capacitive coupling element K2 coupling the resonators 1b and 1c. In addition, capacitance arising between the conductive plating 54a and the electrode 56a, sandwiching the lower layer substrate 50b therebetween, acts as an input capacitive element $C_{IN}$ to the resonator 1a. Likewise, capacitance arising between the conductive plating 54c and the electrode 56b acts as an output capacitive element $C_{OUT}$ to the resonator 1c.

Furthermore, the ground electrode platings 52, 52a and 52b are patterned so as to surround the island electrode 51a. Accordingly, a capacitive element $C_{11}$ effected therebetween. Similarly, a capacitive element $C_{21}$ is effected around the island electrode 51b, and a capacitive element $C_{31}$ is effected around the island electrode 51c. Moreover, the ground electrode platings 55, 55a and 55b are patterned so as to surround the conductive platings 54a and 54x formed interlaminally between the substrate layers 50a and 50b, so that a capacitive element $C_{12}$ is effected therebetween. Capacitive elements $C_{22}$ and $C_{32}$ are likewise effected between conductive platings 54b and 54y, and 54c and 54z, and the ground electrode platings 55, 55b and 55c, and 55, 55c and 55d, respectively patterned so as to surround them.

Additionally, capacitive elements $C_{13}$, $C_{23}$ and $C_{33}$ are effected between respective conductive platings 54x, 54y and 54z, and the ground electrode plating 52 on the opposite surface, sandwiching the upper substrate layer 50a therebetween.

Furthermore, a capacitive elements $C_{14}$, $C_{24}$ and $C_{34}$ are effected by the conductive platings 54x, 54y and 54z, and the ground electrode plating 57 on the opposite surface, sandwiching the lower substrate layer 50b therebetween.

The capacitive elements $C_{11}$, $C_{12}$, $C_{13}$ and $C_{14}$ formed centered with respect to the island electrode 51a and the conductive plating 54a are synthesized in parallel, effecting a parallel capacitive element $C_1$ between the inner conductor 12 of the resonator 1a and potential ground. Likewise, the capacitive elements $C_{21}$, $C_{22}$, $C_{23}$ and $C_{24}$ formed centered with respect to the island electrode 51b and the conductive plating 54b are synthesized in parallel, effecting a parallel capacitive element $C_2$ between the inner conductor 12 of the resonator 1b and potential ground. In the same manner, capacitive elements $C_{31}$, $C_{32}$, $C_{33}$ and $C_{34}$ together effect a parallel capacitive element $C_3$ between the inner conductor 12 of the resonator 1c and potential ground.

Figure 11:
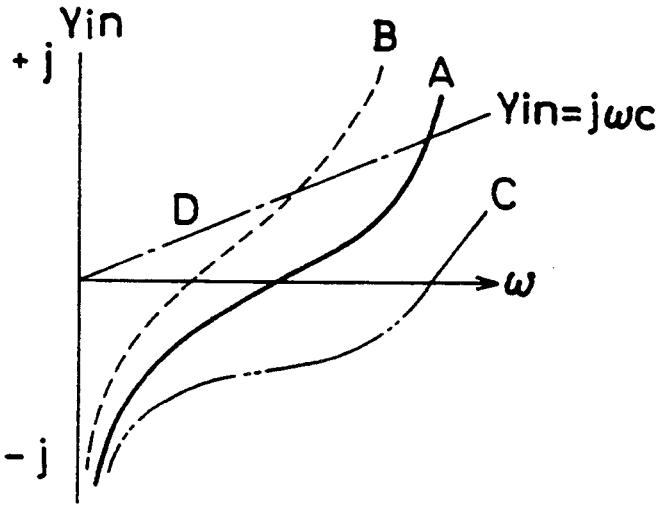
FIG. 11 is a diagram graphing characteristics of the dielectric filter of FIG. 8.

FIG. 11 is a graph showing resonant circular frequency characteristics both for a resonator to which the parallel capacitive elements $C_1$, $C_2$ and $C_3$ is connected, and for one to which they are not connected. In FIG. 11, the vertical axis indicates the admittance, and the horizontal axis indicates the resonant circular frequency of the resonator. The state in which resonance occurs is $Y_{IN}=0$ on the vertical axis. The point at which a curve intersects the horizontal axis is the resonant circular frequency. Dot-and-dash line D extending from the origin is an admittance curve of a parallel capacitive element, and curve A shows the characteristics sought for a given resonator.

Wherein a parallel capacitive element ($j\omega c$) is added to the resonator having the characteristics shown by curve A, the resonant circular frequency of the resonator is thereafter lowered, as indicated by curve B. In order to obtain a resonator having the characteristics sought therefore, it is then permissible to employ a resonator having a higher resonant circular frequency, for example, a resonator previously set to exhibit characteristics as shown by curve C.

The resonant circular frequency $\omega$ is expressed by the following equation:

$$\omega = C\pi/2l\sqrt{\epsilon r}$$

where

C is the speed of light, l is the length of a resonator, and $\epsilon r$ is the dielectric constant of dielectric material constituting the resonator.

That is, if $C\pi$ and $\epsilon r$ are considered as constants, wherein the length l of the resonator is shortened the resonant circular frequency $\omega$ is made higher.

Even if the size of each of the resonators 1*a*, 1*b* and 1*c* constituting the filtering member 1 is small, therefore, desired characteristics can be obtained by joining the parallel capacitive elements $C_1$, $C_2$ and $C_3$ among the inner conductors 12 of the resonators 1*a*, 1*b* and 1*c*, and potential ground.

Moreover, capacitive elements formed between the conductive platings formed interiorly of the substrate, and the ground electrode plating and its extended sections, are interlaminal between the upper and lower substrate layers. Consequently, electric field leakage is restrained from arising between the platings, improving the effective dielectric constant. Even if the distance between the conductive platings and the ground electrode plating and its extended sections is decreased, therefore, $C_1$, $C_2$, and $C_3$ increase; accordingly the length of each resonator can be made shorter still, additionally facilitating miniaturization of the substrate.

Additionally, the filtering member 1 is mounted on and fixed to the ground electrode plating 52, formed on the surface of the substrate 50, through a conductive adhesive such as solder, improving the mechanical joint strength. In addition, almost the entire surface of the outer conductor 13 of the resonators 1*a*, 1*b* and 1*c* is grounded to potential ground through the case 3, thereby stabilizing the filtering characteristics of the filtering member 1.

[Modified Example]

Figure 12A:
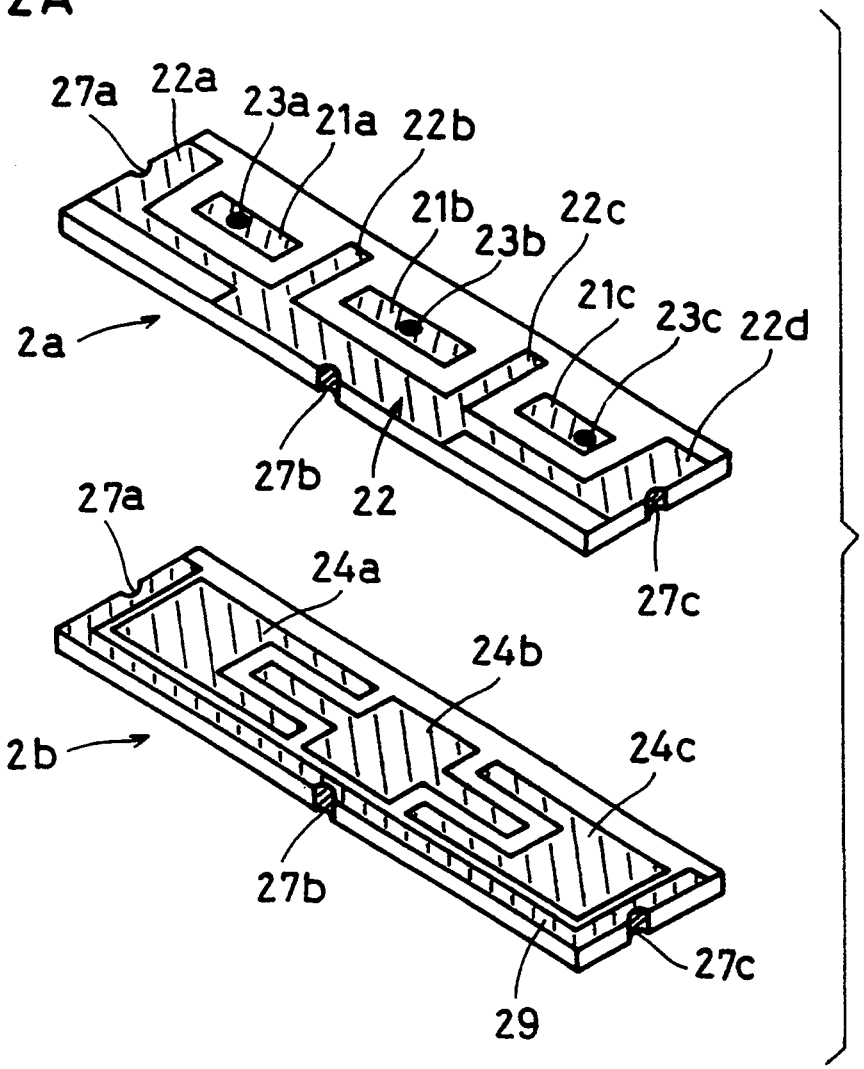
FIG. 12A is an exploded perspective view showing a substrate in a modified example of the second embodiment.
Figure 12B:
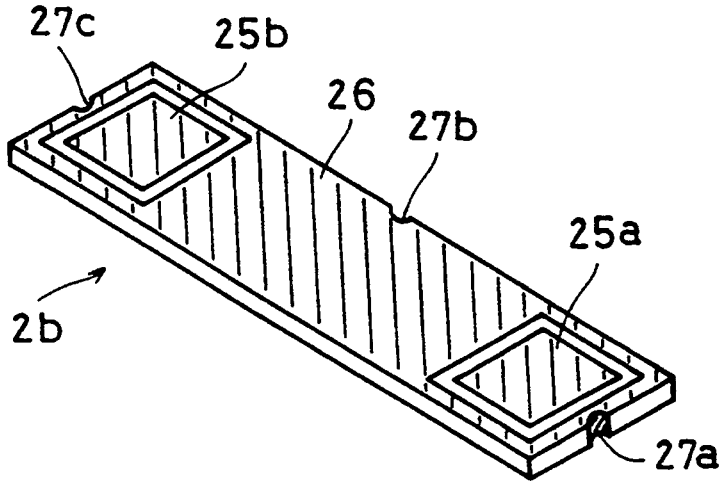
FIG. 12B is a view of the reverse surface of the substrate shown in FIG. 12A.

(a) It is possible to construct a dielectric filter having an equivalent circuit as shown in FIG. 9 even wherein a substrate as shown in FIGS. 12A and 12B is used.

This example is the same as the first embodiment except that a ground electrode plating 29 is formed so as to surround conductive platings 24*a*, 24*b* and 24*c* on the upper surface of the lower substrate layer 2*b* in the first embodiment.

In this case, the height can be shortened, as compared with that in the above-described embodiment in which the filter member is mounted on the substrate.

(b) Although in the foregoing embodiment the substrate has a two-layer structure, it may be of at least a three-layer structure. In this case, it is possible to form a ground electrode plating having a specific pattern between given layers so as to obtain parallel capacitive elements between the ground electrode plating and conductive platings, constituting coupling capacitive elements for coupling inner conductors of respective resonators to one another.

(c) Although in the above-described embodiment description was made for a case wherein the number of resonators constituting the filter member is three, the number of resonators may be increased or decreased, in conformity with the required filtering characteristics. Alternatively, the filter member may be one in which a plurality of inner conductors are formed inside of one dielectric filter ceramic block.

Embodiment 3

Figure 13A:
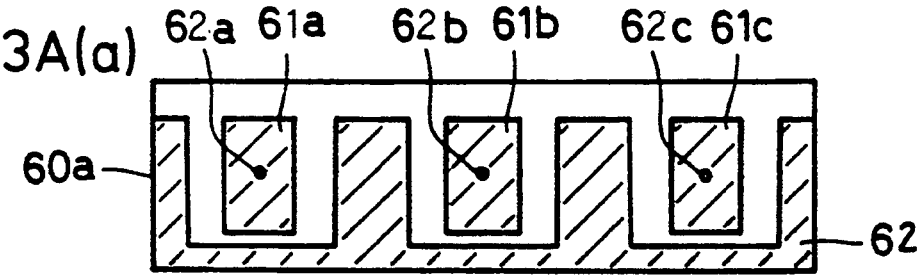
FIG. 13A is a split-level plan view showing a substrate used in a dielectric filter according to a third embodiment of the present invention.
Figure 13A:
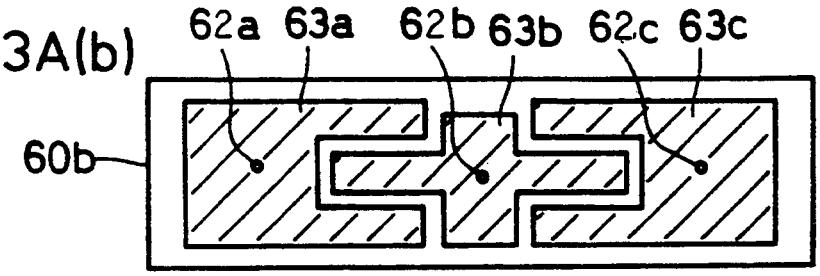
Figure 13A:
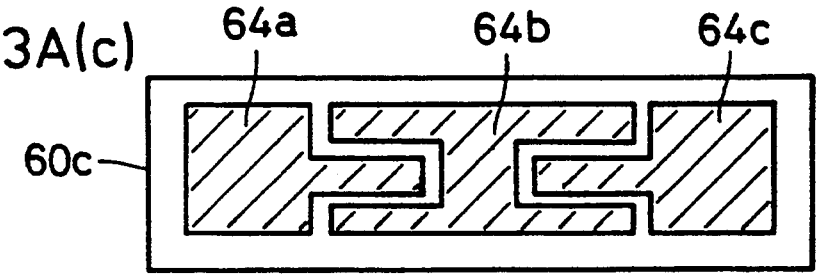
Figure 13B:
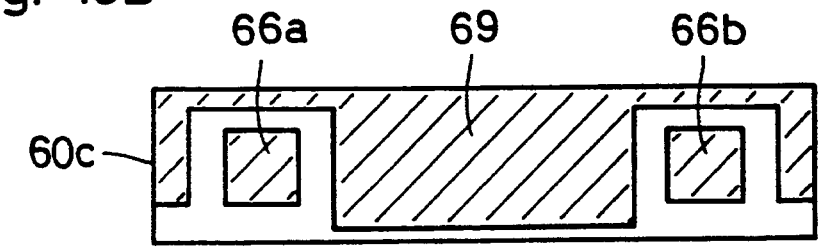
FIG. 13B is a view of the reverse surface of the substrate shown in FIG. 13A.
Figure 14:
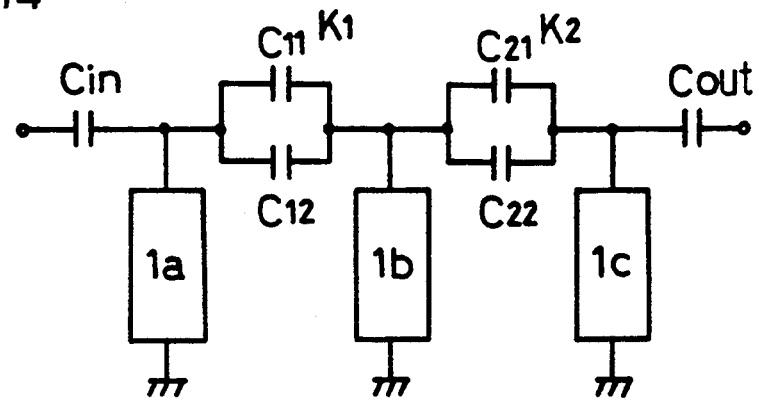
FIG. 14 is a schematic diagraming an equivalent circuit of the dielectric filter according to the third embodiment.

FIGS. 13A and 13B are diagrams illustrating plating patterns of a substrate 60 used in a dielectric filter according to a third embodiment of the present invention, and FIG. 14 is an equivalent circuit diagram of the dielectric filter. The structures of the resonators and case are the same as those in the first embodiment.

The substrate in the present embodiment has a three-layer structure. FIG. 13 A(*a*) shows the upper surface of an upper substrate layer 60*a*, FIG. 13 A(*b*) shows the upper surface of an intermediate substrate layer 60*b*, FIG. 13A (*c*) shows the upper surface of a lower substrate layer 60*c*, and FIG. 13B shows the reverse surface of the lower substrate layer 60*c*.

Island electrode platings 61*a*, 61*b* and 61*c* are formed on the upper surface of the upper substrate layer 60*a*. In addition, conductive platings 63*a*, 63*b* and 63*c* are formed between the upper substrate layer 60*a* and the intermediate substrate layer 60*b*, and conductive platings 64*a*, 64*b* and 64*c* are formed between the intermediate substrate layer 60*b* and the lower substrate layer 60*c*. Furthermore, input/output electrode platings 66*a* and 66*b* are formed on the reverse surface of the lower substrate layer 60*c*, and a ground electrode plating 66 is patterned so as to surround the input/output electrodes 65*a* and 65*b*.

In the dielectric filter thus constructed, a capacitive element $C_{11}$ is effected between the conductive platings 63*a* and 63*b*, and a capacitive element $C_{21}$ is effected between the conductive platings 63*b* and 63*c*. Similarly, between the conductive platings 64*a* and 64*b*, and between the conductive platings 64*b* and 64*c* capacitive elements $C_{12}$ and $C_{22}$ are effected. The capacitive elements $C_{11}$ and $C_{12}$, and $C_{21}$ and $C_{22}$, are respectively connected to each other in parallel via through-holes 62*a*, 62*b* and 62*c*, formed through the island electrodes 61*a*, 61*b* and 61*c* connected to inner conductors 12 of respective resonators 1*a*, 1*b* and 1*c*, effecting respective capacitive coupling elements $K_1$ and $K_2$.

An input capacitive element $C_{IN}$ is the capacitance arising between the conductive plating 64*a*, and the input electrode 65*a*; and an output capacitive element $C_{OUT}$ is the capacitance arising between the conductive plating 64*c*, and the output electrode 65*b*.

In the present embodiment, it is possible to readily achieve a laminated substrate in which the value of the coupling capacitance K is high.

Furthermore, in the present embodiment, the superficial patterning of the conductor platings 63*b*, and 63*a* and 63*c*; and of platings 64*b*, and 64*a* and 64*c*, is such that they interpenetrate transversely on their respective surfaces. Therefore, capacitive elements are effected further in the interstices between the comb pattern of the conductive plating 63*b* and the complementary comb pattern of the conductive platings 64*a* and 64*c*, in addition to the inter-plating capacitive elements, thereby making it possible to obtain a higher value of coupling capacitance.

Embodiment 4

Figure 15A:
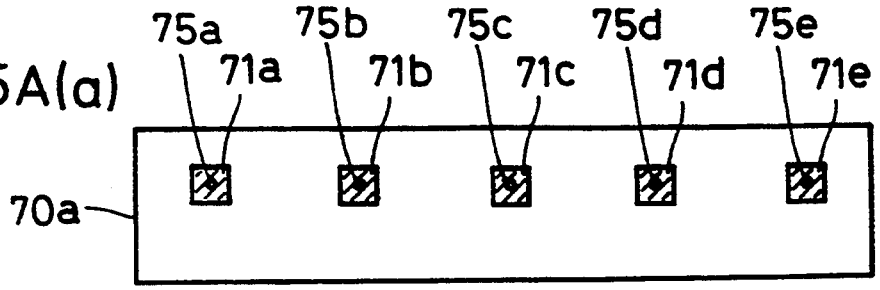
FIG. 15A is a split-level plan view showing a substrate used in a dielectric filter according to a fourth embodiment of the present invention.
Figure 15A:
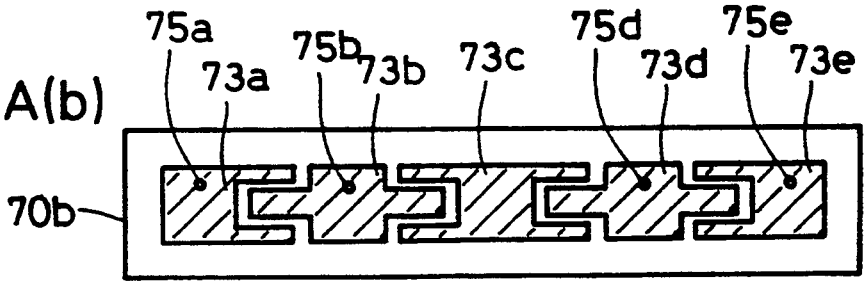
Figure 15A:
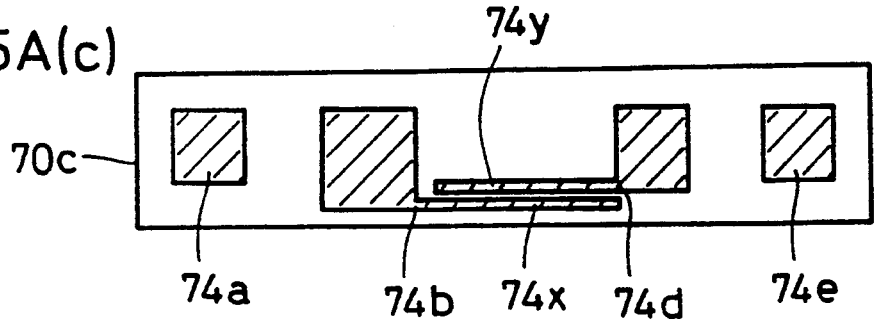
Figure 15B:
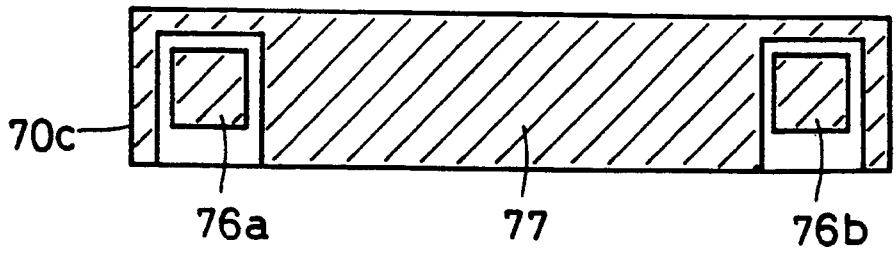
FIG. 15B is a view of the reverse surface of the substrate shown in FIG. 15A.

FIGS. 15A and 15B are diagrams illustrating the structure of a substrate 70 used in a polarizing dielectric filter having five dielectric resonators.

The substrate in the present embodiment has a three-layer structure. FIG. 15 A(*a*) shows the surface of an upper substrate layer 70*a*, FIG. 15 A(*b*) shows the upper surface of an intermediate substrate layer 70*b*, FIG. 15 A(*c*) shows the upper surface of a lower substrate layer 70*c*, and FIG. 15B shows the reverse surface of the lower substrate layer 70*c*. Coupling capacitive elements K between adjacent resonators are effected between the upper substrate layer 70*a* and the intermediate substrate layer 70*b*, and polarizing/coupling capacitive elements, further coupling given resonators according to the polarizing characteristics sought, are effected between the intermediate substrate layer 70*b* and the lower substrate layer 70*c*.

Conductive platings 73*a*, 73*b*, 73*c*, 73*d* and 73*e* effecting inter-resonator coupling capacitances are formed on the upper surface of the upper substrate layer 70*a* such that they are meshed with each other, giving rise to superficial capacitance among interstices.

Furthermore, conductive platings 74*b* and 74*d*, in connecting inner conductors 12 of the second resonator from the left and the fourth resonator from the left to each other effect polarizing characteristics, are formed on the upper surface of the lower substrate layer 70*c*. The conductive platings 74*b* and 74*d* have respective extensions 74*x* and 74*y* mutually extending toward the opposite conductive platings 74*d* and 74*b*. The extensions 74*x* and 74*y* lie in parallel and are set apart at a predetermined gap. Capacitance between the platings acts as a polarizing/coupling capacitive element.

Additionally, conductive platings 74*a* and 74*e* are isolated platings effecting input/output capacitance between each of them and corresponding input/output electrode platings 76*a* and 76*b*, as shown in FIG. 15B; and hence, they can be omitted. If they are omitted, an input capacitive element $C_{IN}$, is effected, for example, between the conductive plating 73*a* and the input electrode 76*a*; and an output capacitive element $C_{OUT}$, is effected, for example, between the conductor pattern 73*e* and the output electrode pattern 76*b*. Through-holes 75*a*, 75*b*, 75*c*, 75*d* and 75*e* therein are for connecting island electrode platings 71*a*, 71*b*, 71*c*, 71*d* and 71*e* to the conductive platings 73*a*, 73*b*, 73*c*, 73*d* and 73*e*, respectively. In addition, the through-holes 75*b* and 75*d* connect the respective island electrodes 71*b* and 71*d*, the conductive platings 73*b* and 73*d*, and the conductive platings 74*b* and 74*d*; and the through-holes 75*a* and 75*e* connect the respective island electrodes 71*a* and 71*e*, the conductive platings 73*a* and 73*e*, and the conductive platings 74*a* and 74*e*.

Embodiment 5

Figure 16A:
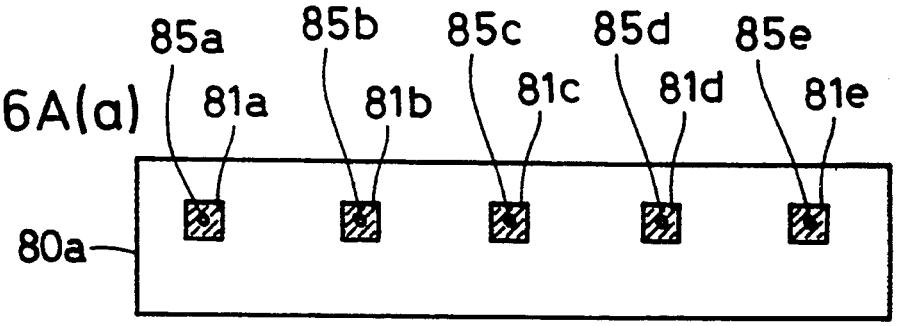
FIG. 16A is a split-level plan view showing a substrate used in a dielectric filter according to a fifth embodiment of the present invention.
Figure 16A:
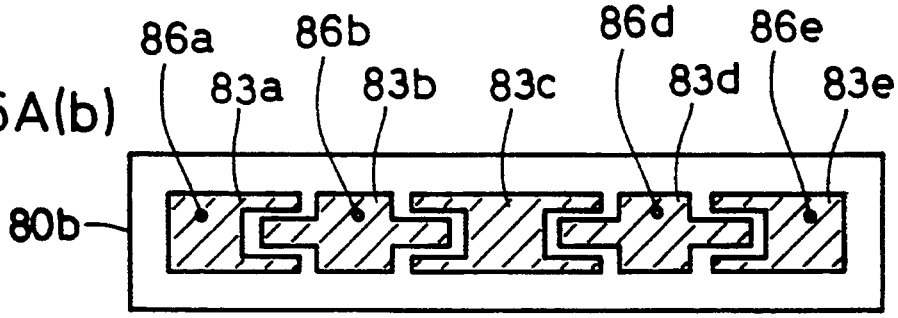
Figure 16A:
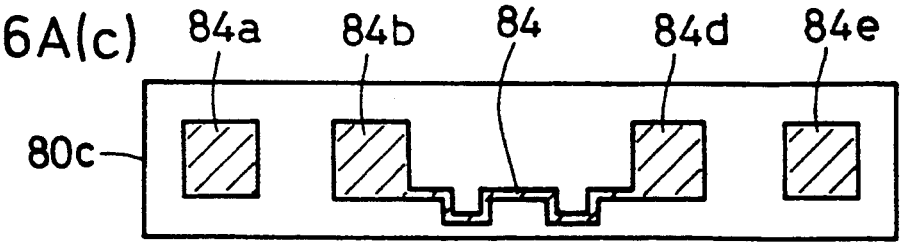
Figure 16B:
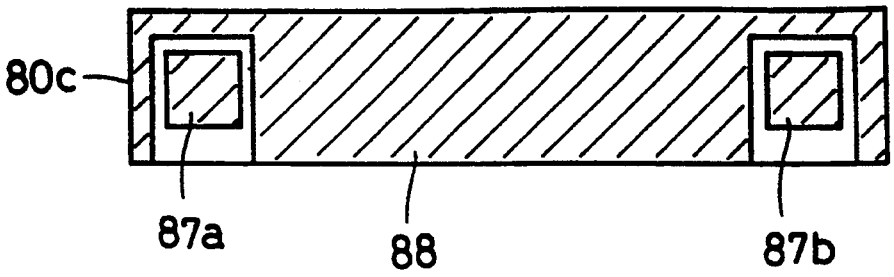
FIG. 16B is a view of the reverse surface of the substrate shown in FIG. 16A.

FIGS. 16A and 16B are diagrams illustrating a laminated substrate 80 used in a dielectric filter according to a fifth embodiment.

The substrate 80 in the present embodiment has a three-layer structure. FIG. 16 A(*a*) shows the upper surface of an upper substrate layer 80*a*, FIG. 16 A(*b*) shows the upper surface of an intermediate substrate layer 80*b*, FIG. 16 A(*c*) shows the upper surface of a lower substrate layer 80*c*, and FIG. 16 B shows the reverse surface of the lower substrate layer 80*c*. Conductive platings 83*a*, 83*b*, 83*c*, 83*d* and 83*e* effecting coupling capacitive elements K between adjacent resonators are formed between the upper substrate layer 80*a* and the intermediate substrate layer 80*b*; and a patterned inductive plating 84, further joining given resonators according to the polarizing characteristics sought, is formed between the intermediate substrate layer 80*b* and the lower substrate layer 80*c*.

The patterned conductive platings 83*a* to 83*e* effecting capacitive coupling elements are patterned on the intermediate substrate layer 80*b* such that they intermesh, effecting capacitance among the interstices.

The patterned inductive plating 84, which, in connecting inner conductors of the second resonator from the left and the fourth resonator from the left to each other effect polarizing characteristics, is formed on the lower layer substrate 80*c*, and pads 84*b* and 84*d* are formed at either end of the inductive plating 84.

Conductive platings 84*a* and 84*e* are isolated platings effecting input/output capacitance between each of them and corresponding input/output electrode platings 87*a* and 87*b*, as shown in FIG. 16B; and hence, they can be omitted. If they are omitted, an input capacitive element $C_{IN}$, is effected, for example, between the conductive plating 83*a* and the input electrode 87*a*; and an output capacitive element $C_{OUT}$, is effected, for example, between the conductive plating 83*e* and the output electrode 87*b*. Through-holes 85*a* to 85*e* therein are for connecting island electrode platings 81*a* to 81*e* to the respective conductive platings 83*a* to 83*e*. Through-holes 86*b* and 86*d* are for respectively connecting the island electrodes 81*b* and 81*d*, the conductive platings 83*b* and 83*d*, and the pads 84*b* and 84*d* of the inductive plating 84. Furthermore, through-holes 86*a* and 86*e* are for respectively connecting the island electrodes 81*a* and 81*e*, the conductive platings 83*a* and 83*e*, and the conductive platings 84*a* and 84*c*.

Thus it is also possible to form the inductive plating 84 within the laminated substrate 80.

Embodiment 6

Figure 17:
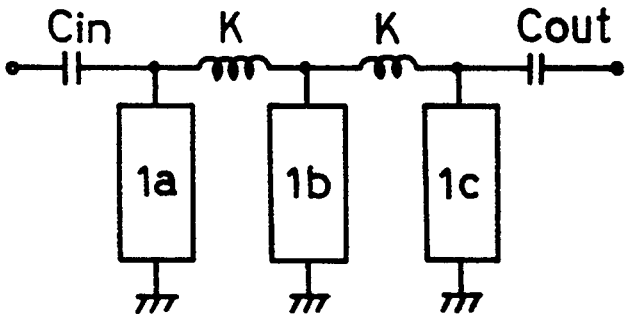
FIG. 17 is a schematic diagraming an equivalent circuit of a dielectric filter according to a sixth embodiment of the present invention.

A sixth embodiment is equivalent to the above described embodiments with the only exception that the patterning of the conductive platings formed on a substrate layer differs from that in the first embodiment, such that its equivalent circuit is as shown in FIG. 17.

Figure 18A:
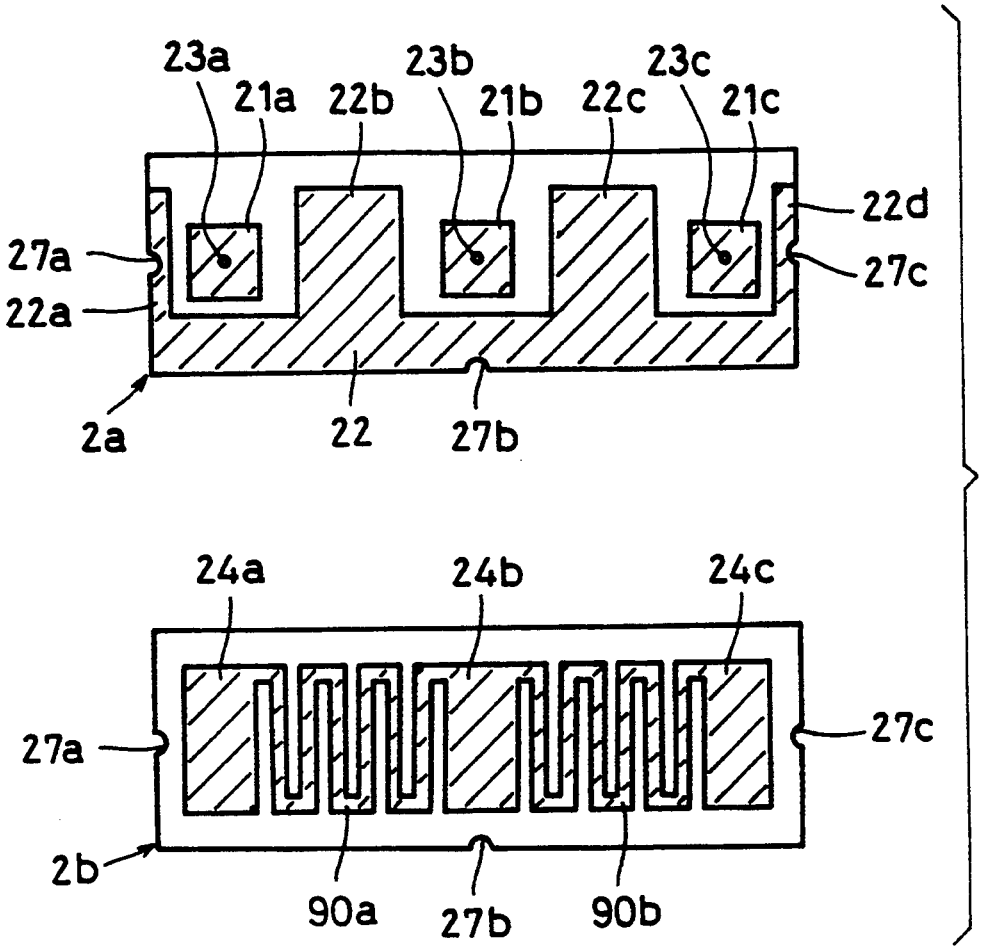
FIG. 18A is a split-level plan view showing a substrate used in the dielectric filter according to the sixth embodiment of the present invention.
Figure 18B:
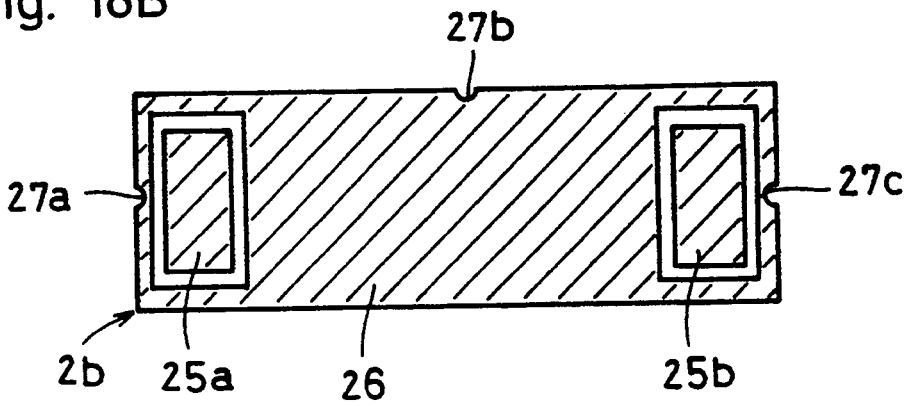
FIG. 18B is a plan view of the reverse surface of the substrate shown in FIG. 18A.

FIG. 18A shows the upper surface of an upper substrate layer 2*a* and the upper surface of a lower substrate layer 2*b*, and FIG. 18B shows the reverse surface of the lower substrate layer 2*b*. Three island electrode platings 21*a*, 21*b* and 21*c* and a ground electrode plating 22 are formed on the upper surface of the upper substrate layer 2*a*. In addition, through-holes 23*a*, 23*b* and 23*c* are formed in the three island electrode platings 21*a*, 21*b* and 21*c* respectively. The ground electrode plating 22 has extended sections 22*a*, 22*b*, 22*c* and 22*d* for segregating the island electrodes 21*a*, 21*b* and 21*c* from one another, so as to shield against stray capacitances between the island electrodes 21*a* and 21*c* among the three island electrodes 21*a*, 21*b* and 21*c*.

Conductive platings 24*a*, 24*b* and 24*c* corresponding to the island electrode platings 21*a*, 21*b* and 21*c*, and connected to the through-holes 23*a*, 23*b* and 23*c*, are formed on the upper surface of the lower substrate layer 2*b*. In addition, two platings patterned so as to effect inductance (hereinafter referred to as inductive platings) 90*a* and 90*b* constituting predetermined inductive coupling elements K are formed among the conductive platings 24a, 24b and 24c. The inductive platings 90a and 90b are zigzag-patterned, so as provide a predetermined length between the conductive platings 24a and 24b and between the conductor patterns 24b and 24c respectively. Consequently, given inductance is effected.

Input/output conductive platings 25a and 25b are formed on the reverse surface of the lower substrate layer 2b so as to correspond to the conductive platings 24a and 24c. A ground electrode plating 26 is also formed on the reverse surface of the lower substrate layer 2b, so as to correspond to the inductive platings 90a and 90b

If the ground electrode plating 26 is of extent wherein it is opposed to the inductive platings 90a and 90b, the inductive platings 90a and 90b function as a microstrip line. On the other hand, if no ground electrode plating correspondingly opposite the inductive platings 90a and 90b is formed on the reverse surface of the lower substrate layer 2b, the inductive platings 90a and 90b become an inductor. In the present embodiment, the ground electrode platings 22 and 26 are formed covering the upper substrate layer 2a and the lower substrate layer 2b, respectively, such that the inductive platings 90a and 90b are sandwiched therebetween and function as microstrip lines.

Furthermore, when the dielectric filter is mounted on a printed circuit board (not shown), it is desirable that there be a ground electrode plating formed on the reverse surface of the laminated substrate 2, because filtering characteristics will be stabilized wherein the outer conductor 13 of the filtering member 1 is extensively grounded to potential ground and portions other than the input/output conductive platings 25a and 25b of the laminated substrate 2 are grounded to potential ground.

In such a dielectric filter, a coupling element K coupling the resonators 1a and 1b is formed in the inductive plating 90a between the conductive platings 24a and 24b, and a coupling element K coupling the resonators 1b and 1c is formed in the inductive plating 90b between the conductive platings 24b and 24c. In addition, an input capacitive element $C_{IN}$ to the resonator 1a is formed between the conductive plating 24a and the input electrode plating 25a formed sandwiching the lower substrate layer 2b therebetween, and an output capacitive element $C_{OUT}$ to the resonator 1c is formed between the conductive plating 24c and the output electrode plating 25b likewise sandwiching the lower substrate layer 2b therebetween.

In the present embodiment, the ground electrode patterns 22 and 26 are formed on the respective surfaces of the substrate layers 2a and 2b whereupon the inductor patterns 90a and 90b are interposed therebetween, such that the inductive platings function as a microstrip line. In this case, the ground electrode platings enable reduction of electric field leakage. In obtaining a microstrip line of predetermined electrical length, therefore, it is possible to reduce the size of the inductive platings and therefore of the substrate.

[Modified Example]

(a) The dielectric filter according to the sixth embodiment may be modified according to the same construction as that of the example illustrated in FIGS. 5 to 7 of the modified first embodiment.

Figure 19A:
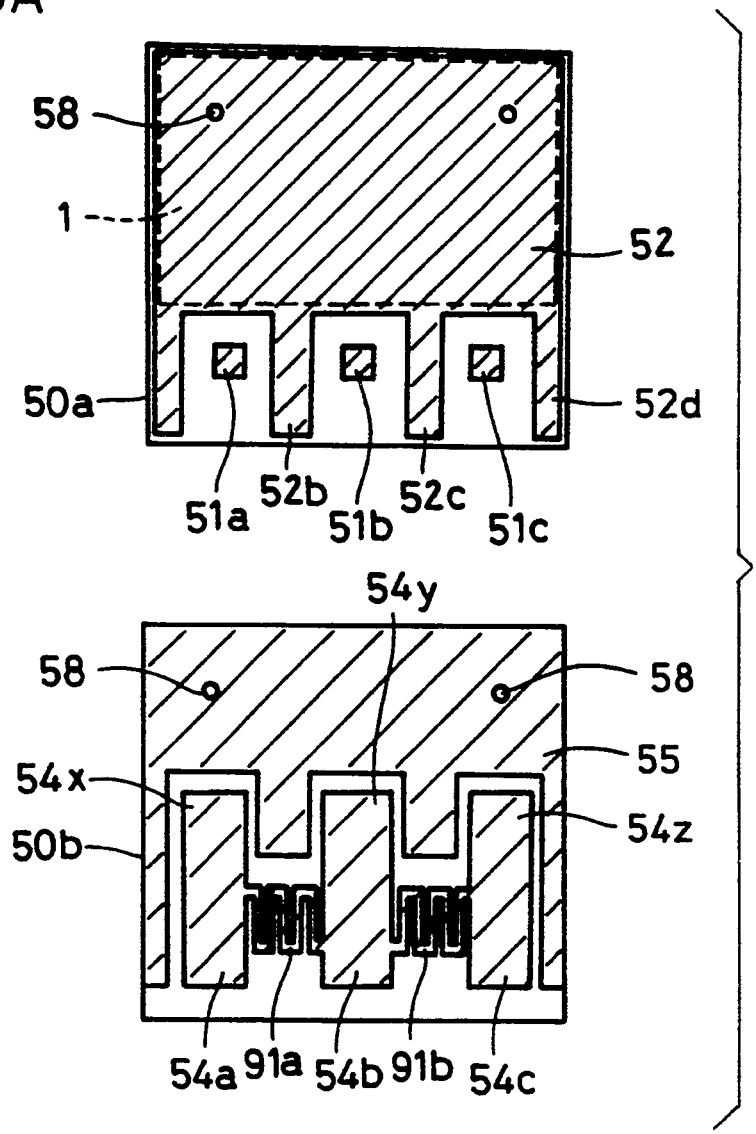
FIG. 19A is a split-level plan view showing a substrate used in a modified example of the sixth embodiment.
Figure 19B:
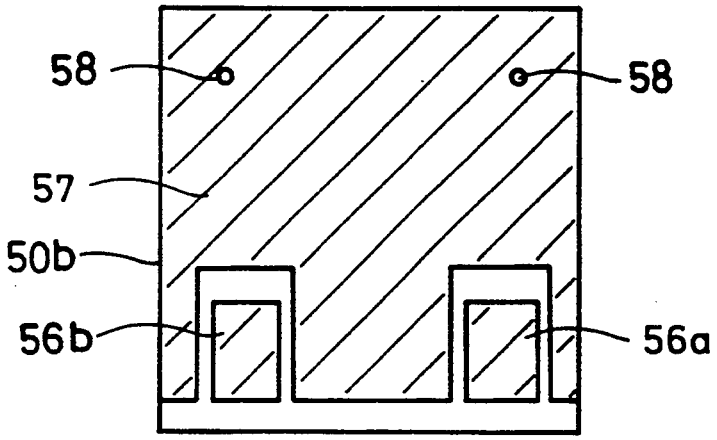
FIG. 19B is a plan view of the reverse surface of the substrate shown in FIG. 19A.
Figure 20:
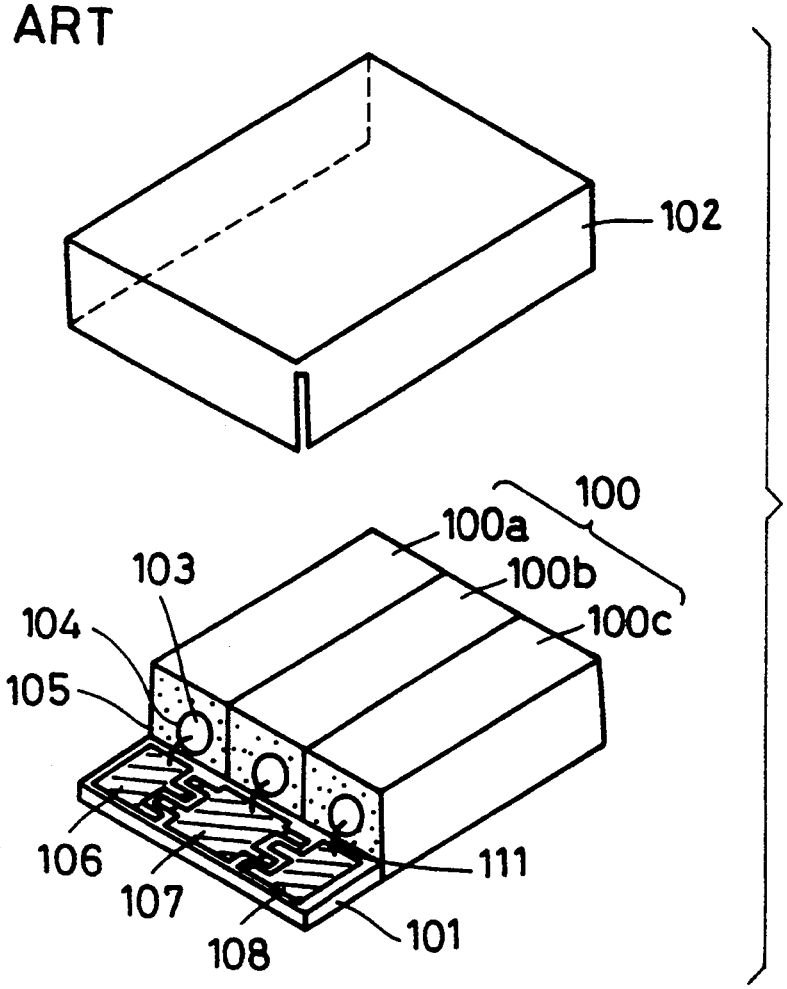
Fig. 20 PRIOR ART
FIG. 20 is an exploded perspective view showing a conventional dielectric filter.
Figure 21:
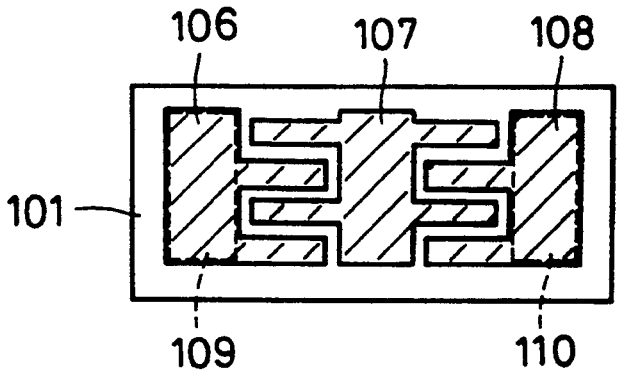
Fig. 21 PRIOR ART
FIG. 21 is a plan view of a substrate in the dielectric filter shown in FIG. 20.

(b) The dielectric filter of the sixth embodiment may likewise be constructed as the second embodiment, in which the entire filter member is mounted on the substrate, as shown in FIGS. 19A and 19B.

Herein, the ground electrode plating 52 extends over the portion of the upper substrate layer 50a surface on which a filtering member 1, indicated by the dotted line, is mounted; and a conductive adhesive such as solder is interposed between the ground electrode plating 52 and the outer conductor 13 of the filtering member 1. Consequently, the joint surface of the filtering member 1 outer conductor 13, and the substrate are brought into common potential ground, meanwhile the joint strength of the filtering member 1 and the substrate is improved.

Moreover, conductor patterns 54a, 54b and 54c on the surface of the lower substrate layer 50b have respective extended sections 54x, 54y and 54z superficially opposite the ground electrode plating 52 on the surface of the upper substrate layer 50a. Consequently, capacitive elements are effected between the ground electrode plating 52 and the conductive plating 54a, 54b and 54c. The capacitive elements are interposed between inner conductors 12 of respective resonators 1a, 1b and 1c and potential ground, and serve to lower the resonance frequency in cooperation with the internal capacitive elements of the resonators 1a, 1b and 1c themselves. By taking into consideration these capacitive elements, therefore, it is possible to utilize a filter member in which the resonance frequency is high, i.e., wherein the length of the resonators is small. Reference numerals 91a and 91b in the figure denote patterned inductive platings.

Furthermore, as shown in FIG. 19B, input/output conductive platings 56a and 56b and a ground electrode plating 57 are formed on the reverse surface of the lower substrate layer 50b. The ground electrode platings 52, 55 and 57 are interconnected via through-holes 58.

(c) The structure of the substrate is not limited to a two-layer structure. For example, the substrate may have a three-layer or four-layer structure.

Wherein the substrate is to have a four-layer structure, island and ground electrode patterned platings are formed on the surface of the uppermost substrate layer, and an inductive plating and a conductive plating are formed between the uppermost substrate layer and the adjoining second substrate layer. In addition, a ground electrode plating is formed so as to correspond to the inductive plating between the second and third substrate layers, and an inductive plating and a conductive plating are formed between the third substrate layer and the lowermost substrate layer. An input/output electrode plating and a ground electrode plating are formed on the reverse surface of the lowermost substrate layer. The conductive plating and the ground electrode platings may be respectively interconnected via through-holes.

(d) Although in the above described embodiments description has been made of cases in which the number of resonators is three, their number is not restricted. In addition, although the filter member is constructed by joining separate resonators to one another, the present invention is applicable to a filter member in which a plurality of inner conductors are formed along cavities in a single dielectric ceramic block.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A dielectric filter, comprising:

a filtering member having a plurality of dielectric resonators, a laminated substrate connected to the filtering member, the laminated substrate comprising a first substrate layer and a second substrate layer, the first substrate layer defining an interior surface and an exterior surface, the second substrate layer defining an interior surface and an exterior surface, wherein the interior surface of the first substrate layer is laminated with the interior surface of the second substrate layer, coupling means formed within the substrate for coupling the plurality of resonators, the coupling means comprising at least one capacitive element, and a plurality of interlaminal conductive platings disposed on the interior surface of the second substrate layer, each one of the plurality of interlaminal conductive platings corresponding to at least one of the plurality of resonators, wherein the at least one capacitive element comprises at least one of the interlaminal conductive platings.

2. The dielectric filter of claim 1, comprising:

an input conductive plating disposed on the exterior surface of the second substrate layer, the input conductive plating being opposed, through the second substrate layer, to a first section of the plurality of interlaminal conductive platings, and an output conductive plating disposed on the exterior surface of the second substrate layer, the output conductive plating being opposed, through the second substrate layer, to a second section of the plurality of interlaminal conductive platings.

3. The dielectric filter of claim 2, comprising:

a first ground conductive plating disposed on the exterior surface of the second substrate layer, the first ground conductive plating substantially surrounding the input conductive plating and the output conductive plating.

4. A dielectric filter, comprising:

a filtering member having a plurality of dielectric resonators, a laminated substrate connected to the filtering member, the laminated substrate comprising a first substrate layer and a second substrate layer, the first substrate layer defining an interior surface and an exterior surface, the second substrate layer defining an interior surface and an exterior surface, coupling means formed within the substrate for coupling the plurality of resonators, the coupling means comprising at least one capacitive element, a plurality of interlaminal conductive platings disposed on the interior surface of the second substrate layer, each one of the plurality of interlaminal conductive platings corresponding to at least one of the plurality of resonators, wherein the at least one capacitive element comprises at least one of the interlaminal conductive platings, an input conductive plating disposed on the exterior surface of the second substrate layer, the input conductive plating being opposed, through the second substrate layer, to a first section of the plurality of interlaminal conductive platings, an output conductive plating disposed on the exterior surface of the second substrate layer, the output conductive plating being opposed, through the second substrate layer, to a second section of the plurality of interlaminal conductive platings, a first ground conductive plating disposed on the exterior surface of the second substrate layer, the first ground conductive plating substantially surrounding the input conductive plating and the output conductive plating, a plurality of conductive island platings disposed on the exterior surface of the first substrate layer, each one of the plurality of conductive island platings corresponding to at least one of the plurality of interlaminal conductive platings and being coupled to at least one of the plurality of resonators, and a second conductive ground plating disposed on the exterior surface of the first substrate layer, the second conductive ground plating having extended sections which separate the plurality of conductive island platings from one another.

5. The dielectric filter of claim 1, wherein the filtering member comprises:

at least one dielectric block having an exterior surface and an interior through-hole defining a bore surface, an inner conductor disposed on the bore surface of the interior through-hole, and an outer conductor disposed on the exterior surface of the dielectric block.

6. The dielectric filter of claim 1, comprising:

a conductive case covering the laminated substrate and the filtering member.

7. A dielectric filter, comprising:

a filtering member having a plurality of dielectric resonators, a laminated substrate connected to the filtering member, the laminated substrate comprising a first substrate layer and a second substrate layer, the first substrate layer defining an interior surface and an exterior surface, the second substrate layer defining an interior surface and an exterior surface, coupling means formed within the substrate for coupling the plurality of resonators, the coupling means comprising at least one capacitive element, a plurality of interlaminal conductive platings disposed on the interior surface of the second substrate layer, each one of the plurality of interlaminal conductive platings corresponding to at least one of the plurality of resonators, wherein the at least one capacitive element comprises at least one of the interlaminal conductive platings, a conductive case covering the laminated substrate and the filtering member, a plurality of conductive island platings disposed on the exterior surface of the first substrate layer, each one of the plurality of conductive island platings corresponding to at least one of the plurality of resonators and being coupled to at least one of the plurality of resonators, and a conductive ground plating disposed on the exterior surface of the first substrate layer, the conductive ground plating having extended sections which separate the plurality of conductive island platings from one another, wherein the case comprises at least one conductive partitioning member in contact with the conductive ground plating disposed on the exterior surface of the first substrate layer.

8. The dielectric filter of claim 7, wherein the case comprises a wall and wherein the at least one conductive partitioning member comprises a bent portion of the wall.

9. A dielectric filter, comprising:

a filtering member having a plurality of dielectric resonators, a laminated substrate connected to the filtering member, the laminated substrate comprising a first substrate layer and a second substrate layer, the first substrate layer defining an interior surface and an exterior surface, the second substrate layer defining an interior surface and an exterior surface, coupling means formed within the substrate for coupling the plurality of resonators, the coupling means comprising at least one capacitive element, a plurality of interlaminal conductive platings disposed on the interior surface of the second substrate layer, each one of the plurality of interlaminal conductive platings corresponding to at least one of the plurality of resonators, wherein the at least one capacitive element comprises at least one of the interlaminal conductive platings, and a conductive case covering the laminated substrate and the filtering member, wherein the filtering member comprises:

at least one dielectric block defining an exterior surface and having an interior through-hole defining a bore surface, an inner conductor disposed on the bore surface of the interior through-hole, and an outer conductor disposed on the exterior surface of the dielectric block, and further comprising:

a plurality of conductive island platings disposed on the exterior surface of the first substrate layer, each one of the plurality of conductive island platings corresponding to at least one of the plurality of resonators and being coupled to an inner conductor, a conductive ground plating disposed on the exterior surface of the first substrate layer, the conductive ground plating having extended sections which separate the plurality of conductive island platings from one another, and wherein the case substantially covers the filtering member and the laminated substrate and comprises at least one conductive partitioning member in contact with an extended section of the conductive ground plating disposed on the exterior surface of the first substrate layer.

10. A dielectric filter, comprising:

a filtering member having a plurality of dielectric resonators, a laminated substrate connected to the filtering member, the laminated substrate comprising a first substrate layer and a second substrate layer, the first substrate layer defining an interior surface and an exterior surface, the second substrate layer defining an interior surface and an exterior surface, coupling means formed within the substrate for coupling the plurality of resonators, the coupling means comprising at least one capacitive element, a plurality of interlaminal conductive platings disposed on the interior surface of the second substrate layer, each one of the plurality of interlaminal conductive platings corresponding to at least one of the plurality of resonators, wherein the at least one capacitive element comprises at least one of the interlaminal conductive platings, a plurality of conductive island platings disposed on the exterior surface of the first substrate layer, each one of the plurality of conductive island platings corresponding to at least one of the plurality of resonators and being coupled to at least one of the plurality of resonators, and a conductive ground plating disposed on the exterior surface of the first substrate layer, the conductive ground plating having extended sections which separate the plurality of conductive island platings from one another.

* * * * *